US011373597B2

(12) United States Patent
Wang et al.

(10) Patent No.: US 11,373,597 B2
(45) Date of Patent: Jun. 28, 2022

(54) ORGANIC LIGHT EMITTING DIODE DISPLAY DEVICE AND METHOD OF DRIVING THE SAME

(71) Applicant: Samsung Display Co., Ltd., Yongin-Si (KR)

(72) Inventors: Seong Min Wang, Seongnam-si (KR); Ji Hye Kong, Seongnam-si (KR); Yong Ho Yang, Suwon-si (KR); Jeong-Soo Lee, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/168,061

(22) Filed: Feb. 4, 2021

(65) Prior Publication Data

US 2021/0264857 A1 Aug. 26, 2021

(30) Foreign Application Priority Data

Feb. 24, 2020 (KR) ..... 10-2020-0022044

(51) Int. Cl.

| | |
|---|---|
| ***G09G 3/3233*** | (2016.01) |
| ***G09G 3/3258*** | (2016.01) |
| ***G09G 3/3291*** | (2016.01) |
| ***G09G 3/3266*** | (2016.01) |

(52) U.S. Cl.

CPC ..... *G09G 3/3258* (2013.01); *G09G 3/3266* (2013.01); *G09G 3/3291* (2013.01); *G09G 3/3233* (2013.01); *G09G 2300/0819* (2013.01); *G09G 2310/08* (2013.01)

(58) Field of Classification Search

CPC .. G09G 3/3208; G09G 3/3233; G09G 3/3258; G09G 3/3291; G09G 3/3266; G09G 2300/043; G09G 2300/0819; G09G 2300/0842; G09G 2300/0852; G09G 2300/0861; G09G 2310/0251; G09G 2310/0262; G09G 2310/06; G09G 2310/08; G09G 2320/0209; G09G 2320/0219; G09G 2320/045; G09G 2320/046; G09G 2330/00; G09G 2360/16

See application file for complete search history.

(56) References Cited

U.S. PATENT DOCUMENTS 10,964,264 B1 * 3/2021 Kim ..... G09G 3/325
2015/0294618 A1 * 10/2015 Park ..... G09G 3/3291 345/214

(Continued)

FOREIGN PATENT DOCUMENTS

KR 10-0560780 B1 3/2006
KR 10-2019-0075194 A 7/2019

*Primary Examiner* — Michael J Eurice

(74) *Attorney, Agent, or Firm* — Innovation Counsel LLP

(57) ABSTRACT

A display device includes a display panel, a driving circuit, and a power supply. The driving circuit is connected to a plurality of pixels of the display panel through a plurality of scan line sets and a plurality of data lines, provides a plurality of scan signals to the display panel, and provides data voltages to the plurality of data lines. The power supply applies one or more power voltages to the plurality of pixels. The driving circuit enables at least two scan signals of the plurality of scan signals during a non-emission interval, partially overlapping the at least two scan signals during at least two consecutive horizontal periods.

20 Claims, 14 Drawing Sheets

(56) References Cited

U.S. PATENT DOCUMENTS

| | | | | |
|---|---|---|---|---|
| 2016/0104423 | A1* | 4/2016 | Park | G09G 3/3233 345/78 |
| 2016/0217739 | A1* | 7/2016 | Kang | G09G 3/3233 |
| 2016/0365035 | A1* | 12/2016 | Park | G09G 3/3266 |
| 2019/0164491 | A1* | 5/2019 | Kim | H01L 27/3248 |

* cited by examiner

ORGANIC LIGHT EMITTING DIODE DISPLAY DEVICE AND METHOD OF DRIVING THE SAME

CROSS-REFERENCE TO RELATED APPLICATION(S)

This application claims priority under 35 USC § 119 to Korean Patent Applications No. 10-2020-0022044, filed on Feb. 24, 2020 in the Korean Intellectual Property Office (KIPO), the disclosure of which is incorporated herein in its entirety by reference.

BACKGROUND

1. Technical Field

Example embodiments of the present disclosure generally relate to display devices. More particularly, example embodiments of the present disclosure relate to organic light emitting diode (OLED) display devices and methods of driving the same.

2. Description of the Related Art

Various flat panel display devices with reduced weight and volume have been developed. An OLED display device has advantages over other flat panel display devices for its rapid response speed and low power consumption. The OLED device displays an image using an organic light emitting diode that emits light based on recombination of electrons and holes.

The OLED display device may include a display panel including a plurality of pixels arranged in a matrix format, and each of the pixels may include one or more transistors and an OLED element that emits light corresponding to an applied voltage.

Recently, the OLED display device is driven with a high frequency, and it causes a reduction of scan-on time. The reduction of scan-on time may generate crosstalk and low gray-level staining and may increase an occupied area of a driving circuit.

SUMMARY

Some example embodiments of the present disclosure provide a display device (e.g., an OLED display device) capable of increasing scan-on time and reducing an occupied area of a driving circuit.

Some example embodiments of the present disclosure provide a method of operating a display device (e.g., an OLED device) that is capable of increasing scan-on time and reducing an occupied area of a driving circuit.

According to one example embodiment, a display device includes a display panel, a driving circuit, and a power supply. The driving circuit is connected to a plurality of pixels of the display panel through a plurality of scan line sets and a plurality of data lines, and configured to provide a plurality of scan signals to the display panel and provide data voltages to the plurality of data lines. The power supply is configured to apply one or more power voltages to the plurality of pixels. The driving circuit is configured to enable at least two scan signals of the plurality of scan signals during a non-emission interval, partially overlapping the at least two scan signals during at least two consecutive horizontal periods. A horizontal period corresponds to a period in which the driving circuit provides the data voltages to a pixel row of the plurality of pixels.

In example embodiments, the driving circuit may include a scan driver, a data driver, an emission driver, and a timing controller. The scan driver may provide a first scan signal, a second scan signal, a third scan signal, and a fourth scan signal to each of pixel rows of the plurality of pixels. The data driver may provide the data voltages corresponding to a data signal to the plurality of data lines connected to the plurality of pixels. The emission driver may provide emission control signals to a plurality emission control lines connected to the plurality of pixels. The timing controller may control the scan driver, the data driver, the emission driver, and the power supply. The timing controller may generate the data signal based on an input image data.

In example embodiments, the one or more power voltages may include a low power supply voltage, a high power supply voltage, a first initialization voltage, a second initialization voltage, and a bias voltage. Each of the plurality of scan line sets may include a first scan line, a second scan line, a third scan line and a fourth scan line. Each of the plurality of pixels may include: a switching transistor that has a first electrode coupled to a data line of the plurality of data lines, a gate coupled to the first scan line, and a second electrode coupled to a first node; a storage capacitor coupled between the high power supply voltage and a second node; a driving transistor that has a first electrode coupled to the first node, a gate coupled to the second node, and a second electrode coupled to a third node; a compensation transistor that has a first electrode coupled to the second node, a gate coupled to the third scan line, and a second electrode coupled to the third node; a first initialization transistor that has a first electrode coupled to the second node, a gate coupled to the first scan line, and a second electrode coupled to the first initialization voltage; a first emission transistor that has a first electrode coupled to the high power supply voltage, a gate receiving an emission control signal of the emission control signals, and a second electrode coupled to the first node; a second emission transistor that has a first electrode coupled to the third node, a gate receiving the emission control signal of the emission control signals, and a second electrode coupled to a fourth node; a second initialization transistor that has a first electrode coupled to the fourth node, a gate coupled to the fourth scan line, and a second electrode coupled to the second initialization voltage; a bias transistor that has a first electrode coupled to the third node, a gate coupled to the fourth scan line, and a second electrode coupled to the bias voltage; and a light emitting element coupled between the fourth node and the low power supply voltage.

In one embodiment, the emission driver may disable the emission control signal with a logic high level during the non-emission interval. The non-emission interval may include consecutive horizontal periods including first through sixth horizontal periods. The scan driver may include a first scan driver that generates the first scan signal, the second scan signal, and the third scan signal, and a second scan driver that generates the fourth scan signal. For a k-th pixel row of the pixel rows, the scan driver may enable the fourth scan signal during the second horizontal period, may enable the first scan signal during the third horizontal period, may enable the second scan signal during the fourth and fifth horizontal periods, and may enable the third scan signal during the fifth and sixth horizontal periods. Here, k may be a natural number.

The scan driver may use the third scan signal for the k-th pixel row as the second scan signal for a (k+1)-th pixel row of the pixel rows.

The second initialization transistor may transfer the second initialization voltage to an anode of the light emitting element in response to the fourth scan signal received through the fourth scan line. The bias transistor may transfer the bias voltage to the second electrode of the driving transistor in response to the fourth scan signal received through the fourth scan line.

In one embodiment, the emission driver may disable the emission control signal with a logic high level during the non-emission interval. The non-emission interval may include consecutive horizontal periods including first through sixth horizontal periods. The scan driver may include a first scan driver that generates the first scan signal, the second scan signal, and the third scan signal, and a second scan driver that generates the fourth scan signal. For a k-th pixel row of the pixel rows, the scan driver may enable the first scan signal during the second horizontal period, may enable the second scan signal during the third and fourth horizontal periods, may enable the third scan signal during the fourth and fifth horizontal periods, and may enable the fourth scan signal during the sixth horizontal period. Here, k may be a natural number.

The scan driver may use the third scan signal for the k-th pixel row as the second scan signal for a (k+1)-th pixel row of the pixel rows.

In one embodiment, the emission driver may disable the emission control signal with a logic high level during the non-emission interval. The non-emission interval may include consecutive horizontal periods including first through sixth horizontal periods. The scan driver may include a first scan driver that generates the first scan signal, the second scan signal, and the third scan signal, and a second scan driver that generates the fourth scan signal. For a k-th pixel row of the pixel rows, the scan driver may enable the first scan signal during the second and third horizontal periods, may enable the second scan signal during the third and fourth horizontal periods, may enable the third scan signal during the fourth and fifth horizontal periods, and may enable the fourth scan signal during the sixth horizontal period. Here, k may be a natural number.

In one embodiment, the emission driver may disable the emission control signal with a logic high level during the non-emission interval. The non-emission interval may include consecutive horizontal periods including first through seventh horizontal periods. The scan driver may generate the first scan signal, the second scan signal, the third scan signal, and the fourth scan signal. For a k-th pixel row of the pixel rows, the scan driver may enable the first scan signal during the second horizontal period, may enable the second scan signal during the third and fourth horizontal periods, may enable the third scan signal during the fourth and fifth horizontal periods, and may enable the fourth scan signal during the sixth and seventh horizontal periods. Here, k may be a natural number.

The scan driver may use the third scan signal for the k-th pixel row as the second scan signal for a (k+1)-th pixel row of the pixel rows.

In one embodiment, the emission driver may disable the emission control signal with a logic high level during the non-emission interval. The non-emission interval may include consecutive horizontal periods including first through seventh horizontal periods. The scan driver may generate the first scan signal, the second scan signal, the third scan signal, and the fourth scan signal. For a k-th pixel row of the pixel rows, the scan driver may enable the fourth scan signal during the second and third horizontal periods, may enable the first scan signal during the fourth horizontal period, may enable the second scan signal during the fifth and sixth horizontal periods, and may enable the third scan signal during the sixth and seventh horizontal periods. Here, k may be a natural number.

The scan driver may use the third scan signal for the k-th pixel row as the second scan signal for a (k+1)-th pixel row of the pixel rows.

In example embodiments, the one or more power voltages may include a low power supply voltage, a high power supply voltage, a first initialization voltage, a second initialization voltage, and a bias voltage. Each of the plurality of scan line sets may include a first scan line, a second scan line, a third scan line, and a fourth scan line. Each of the plurality of pixels may include: a switching transistor that has a first electrode coupled to a data line of the data lines, a gate coupled to the first scan line, and a second electrode coupled to a first node; a storage capacitor coupled between the high power supply voltage and a second node; a driving transistor that has a first electrode coupled to the first node, a gate coupled to the second node, and a second electrode coupled to a third node; a compensation transistor that has a first electrode coupled to the second node, a gate coupled to the third scan line, and a second electrode coupled to the third node; a first initialization transistor that has a first electrode coupled to the second node, a gate coupled to the first scan line, and a second electrode coupled to the first initialization voltage; a first emission transistor that has a first electrode coupled to the high power supply voltage, a gate receiving an emission signal of the emission control signals, and a second electrode coupled to the first node; a second emission transistor that has a first electrode coupled to the third node, a gate receiving the emission signal of the emission control signals, and a second electrode coupled to a fourth node; a second initialization transistor that has a first electrode coupled to the fourth node, a gate coupled to the fourth scan line, and a second electrode coupled to the second initialization voltage; a bias transistor that has a first electrode coupled to the first node, a gate coupled to the fourth scan line, and a second electrode coupled to the bias voltage; and a light emitting element coupled between the fourth node and the low power supply voltage.

The second initialization transistor may transfer the second initialization voltage to an anode of the light emitting element in response to the fourth scan signal received through the fourth scan line. The bias transistor may transfer the bias voltage to the first electrode of the driving transistor in response to the fourth scan signal received through the fourth scan line.

In example embodiments, a level of the first initialization voltage may be greater than a level of the second initialization voltage.

In example embodiments, the power supply may vary a level of the second initialization voltage and a level of the bias voltage based on a frame rate of an image displayed in the display panel.

According to one example embodiment, a method of driving a display device includes: outputting data voltages a plurality of pixels of a display panel, by a data driver connected to the display panel through a plurality of data lines; and sequentially outputting a plurality of scan signals to the plurality of pixels, by a scan driver connected to the display panel through a plurality of scan line sets. The scan driver enables at least two scan signals of the plurality of scan signals during a non-emission interval, partially overlapping the at least two scan signals during at least two consecutive horizontal periods. A horizontal period corresponds to a period in which the driving circuit provides the data voltages to a pixel row of the plurality of pixels.

In example embodiments, each of the plurality of scan line sets may include a first scan line, a second scan line, a third scan line, and a fourth scan line. Each of the plurality of pixels may include: a switching transistor that has a first electrode coupled to a data line of the plurality of data lines, a gate coupled to the first scan line, and a second electrode coupled to a first node; a storage capacitor coupled between a high power supply voltage and a second node; a driving transistor that has a first electrode coupled to the first node, a gate coupled to the second node, and a second electrode coupled to a third node; a compensation transistor that has a first electrode coupled to the second node, a gate coupled to the third scan line, and a second electrode coupled to the third node; a first initialization transistor that has a first electrode coupled to the second node, a gate coupled to the first scan line, and a second electrode coupled to a first initialization voltage; a first emission transistor that has a first electrode coupled to the high power supply voltage, a gate receiving an emission control signal, and a second electrode coupled to the first node; a second emission transistor that has a first electrode coupled to the third node, a gate receiving the emission control signal, and a second electrode coupled to a fourth node; a second initialization transistor that has a first electrode coupled to the fourth node, a gate coupled to the fourth scan line, and a second electrode coupled to a second initialization voltage; a bias transistor that has a first electrode coupled to the third node, a gate coupled to the fourth scan line, and a second electrode coupled to a bias voltage; and a light emitting element coupled between the fourth node and a low power supply voltage.

In one embodiment, the emission control signal may be disabled with a logic high level during the non-emission interval. The non-emission interval may include consecutive horizontal periods including first through sixth horizontal periods. The scan driver may include a first scan driver that generates a first scan signal, a second scan signal, and a third scan signal, and a second scan driver that generates a fourth scan signal. For a k-th pixel row of the pixel rows, the scan driver may enable the fourth scan signal during the second horizontal period, may enable the first scan signal during the third horizontal period, may enable the second scan signal during the fourth and fifth horizontal periods, and may enable the third scan signal during the fifth and sixth horizontal periods. Here, k may be a natural number.

Accordingly, the scan driver of the display device (e.g., an OLED display device) may enable at least two scan signals of a plurality of scan signals during a non-emission interval in which the pixels do not emit light, partially overlapping the at least two scan signals during at least two consecutive horizontal periods, thereby increasing scan-on time. Therefore, the scan driver may reduce crosstalk and low gray-level staining when the display device is driven with a high frequency. In addition, circuits for generating the scan signals may be fabricated by merging some of the circuits for generating the scan signals, and thus an occupied area by the scan driver may be reduced, thereby reducing a dead space of the display device.

BRIEF DESCRIPTION OF THE DRAWINGS

Illustrative, non-limiting example embodiments of the present disclosure will be more clearly understood from the following detailed description in conjunction with the accompanying drawings.

DESCRIPTION OF EMBODIMENTS

Figure 1:
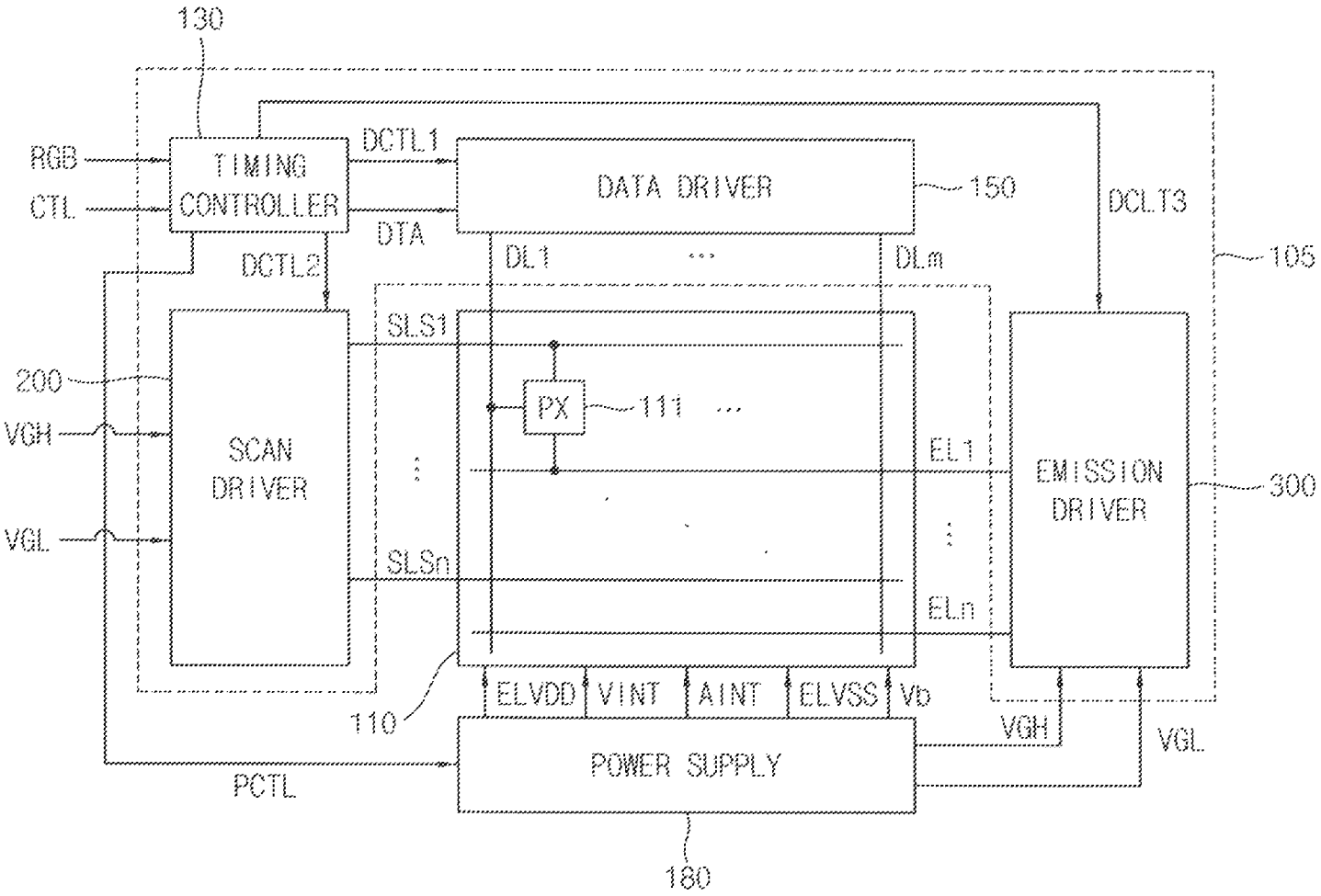
FIG. 1 is a block diagram illustrating an organic light emitting diode (OLED) display device according to an example embodiment.

Example embodiments of the present disclosure are described more fully hereinafter with reference to the accompanying drawings. The inventive concept of the present disclosure may, however, be embodied in many different forms and configurations, and should not be construed as limited to the example embodiments set forth herein.

It will be understood that when an element or layer is referred to as being "on," "connected to," or "coupled to" another element or layer, it can be directly on, connected or coupled to the other element or layer or one or more intervening elements or layers may be present therebetween. In contrast, when an element is referred to as being "directly on," "directly connected to," or "directly coupled to" another element or layer, there may be no intervening elements or layers present therebetween. Like or similar reference numerals refer to like or similar elements throughout the present disclosure. As used herein, the term "and/or" includes any and all combinations of one or more of the associated listed items.

It will be understood that, although the terms first, second, third etc. may be used herein to describe various elements, components, regions, layers, patterns, and/or sections, these elements, components, regions, layers, patterns, and/or sections should not be limited by these terms.

The terminology used herein is for the purpose of describing particular example embodiments only and is not intended to be limiting of the present disclosure. As used herein, singular forms such as "a," "an," and "the" are intended to include plural forms as well, unless the context clearly indicates otherwise. It will be further understood that the terms "comprises" and/or "comprising," when used in the present disclosure, specify a presence of stated features, integers, steps, operations, elements, and/or components, but do not preclude a presence or addition of one or more other features, integers, steps, operations, elements, components, and/or groups thereof.

Example embodiments are described herein with reference to schematic illustrations of idealized example embodiments (and intermediate structures) of the inventive concept. As such, variations from the shapes of the illustrations as a result, for example, of manufacturing techniques and/or tolerances, are to be expected. Thus, the example embodiments should not be construed as limited to the particular shapes of regions illustrated herein but are to include deviations in shapes that are expected to result, for example, from manufacturing. The regions illustrated in the drawings are schematic in nature, and their shapes are not intended to illustrate an actual shape of a region of a device and are not intended to limit the scope of the inventive concept.

Unless otherwise defined or expressly stated, terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The example embodiments of the present disclosure are described more fully hereinafter with reference to the accompanying drawings. Like or similar reference numerals refer to like or similar elements throughout the present disclosure.

FIG. 1 is a block diagram illustrating an organic light emitting diode (OLED) display device according to an example embodiment. Although the OLED display device is described herein, it is understood that the present disclosure is not limited thereto. For example, various other display devices such as, but not limited to, quantum dot display devices, liquid crystal display (LCD) devices, and micro light emitting diode (LED) display devices.

Referring to FIG. 1 an OLED display device 100 may include a driving circuit 105, a display panel 110, and a power supply 180.

The driving circuit 105 may include a timing controller 130, a data driver 150, a scan driver 200, and an emission driver 300. The timing controller 130, the data driver 150, the scan driver 200, and the emission driver 300 may be coupled to the display panel 110 in the form of a chip-on flexible (COF) printed circuit, a chip-on glass (COG), a flexible printed circuit (FPC), etc.

The display panel 110 may be coupled to the scan driver 200 of the driving circuit 105 through a plurality of scan signals grouped in a plurality of scan line sets SLS1~SLSn (n is an integer) may be coupled to the data driver 150 through a plurality of data lines DL1~DLm (m is an integer), and may be coupled to the emission driver 300 of the driving circuit 105 through a plurality of emission control lines EL1~ELn. The display panel 110 may include a plurality of pixels 111, and each pixel 111 is disposed at an intersection of each of the scan line sets SLS1~SLSn, each of the data lines DL1~DLm, and each of the emission control lines EL1~ELn.

The power supply 180 may provide a high power supply voltage ELVDD, a low power supply voltage ELVSS, a first initialization voltage VINT, a second initialization voltage AINT, and a bias voltage Vb to the display panel 110. The power supply 180 may provide a first voltage VGH and a second voltage VGL to the emission driver 300.

The scan driver 200 may apply the plurality of scan signals to each of the pixels 111 through a first group of scan lines (e.g., SL11~SL1*n*) and a second group of scan lines (e.g., SL21~SL2*n*) based on a second driving control signal DCTL2. The scan driver 200 may enable at least two scan signals of the plurality of scan signals during a non-emission interval in which the pixels 111 do not emit light such that the scan signals are partially overlapped during two consecutive horizontal periods. The horizontal period corresponds to a period in which the driving circuit 105 provides data voltages to one pixel row of the pixels 111.

The data driver 150 may apply data voltages to the pixels 111 through the plurality of data lines DL1~DLm based on a first driving control signal DCTL1.

The emission driver 300 may apply an emission control signal to each of the pixels 111 through the plurality of emission control lines EL1~ELn based on a third driving control signal DCTL3. Luminance of the display panel 110 may be adjusted based on the emission control signal.

The power supply 180 may provide the high power supply voltage ELVDD, the low power supply voltage ELVSS, the first initialization voltage VINT, the second initialization voltage AINT, and the bias voltage Vb to the display panel 110, and may further provide the first voltage VGH and the second voltage VGL to the emission driver 300 and the scan driver 200, in response to a power control signal PCTL.

The power supply 180 may vary a level of the second initialization voltage AINT and a level of the bias voltage Vb based on the power control signal PCTL indicating a frame rate of an image displayed by the display panel 110.

The timing controller 130 may receive input image data RGB and a control signal CTL, and may generate the first, second, and third driving control signals DCTL1~DCTL3 and the power control signal PCTL based on the control signal CTL. The timing controller 130 may provide the first driving control signal DCTL1 to the data driver 150, the second driving control signal DCTL2 to the scan driver 200, the third driving control signal DCTL3 to the emission driver 300, and the power control signal PCTL to the power supply 180. The timing controller 130 may receive the input image data RGB and arrange the input image data RGB to provide a data signal DTA to the data driver 150.

Figure 2:
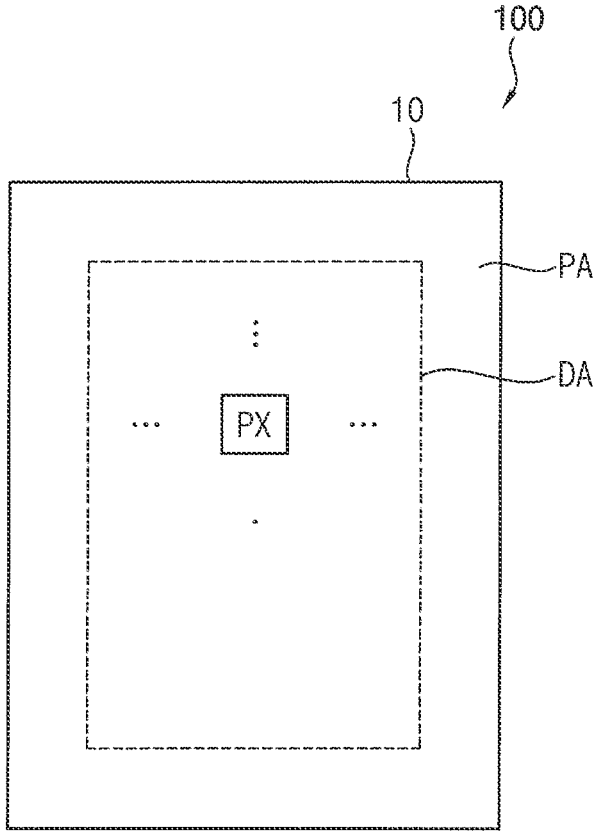
FIG. 2 is a plan view of the OLED display device of FIG. 1 according to an example embodiment.

FIG. 2 is a plan view of the OLED display device 100 of FIG. 1 according to an example embodiment.

Referring to FIG. 2 the OLED display device 100 includes a substrate 10. The substrate 10 may include a display region DA and a peripheral region PA outside the display region DA.

The plurality of pixels 111 may be arranged in the display region DA of the substrate 10. Various wirings for transmitting an electrical signal to the driving circuit 105 and the display region DA may be arranged in the peripheral region PA of the substrate 10.

Figure 3:
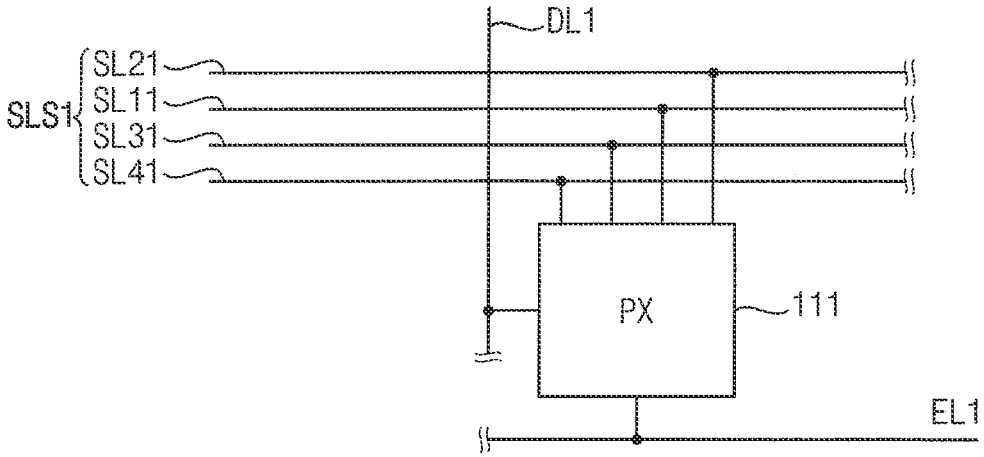
FIG. 3 illustrates an electrical connection diagram illustrating a pixel included in the OLED display device of FIG. 1.

FIG. 3 illustrates an electrical connection diagram illustrating a pixel included in the OLED display device 100 of FIG. 1.

Figure 4:
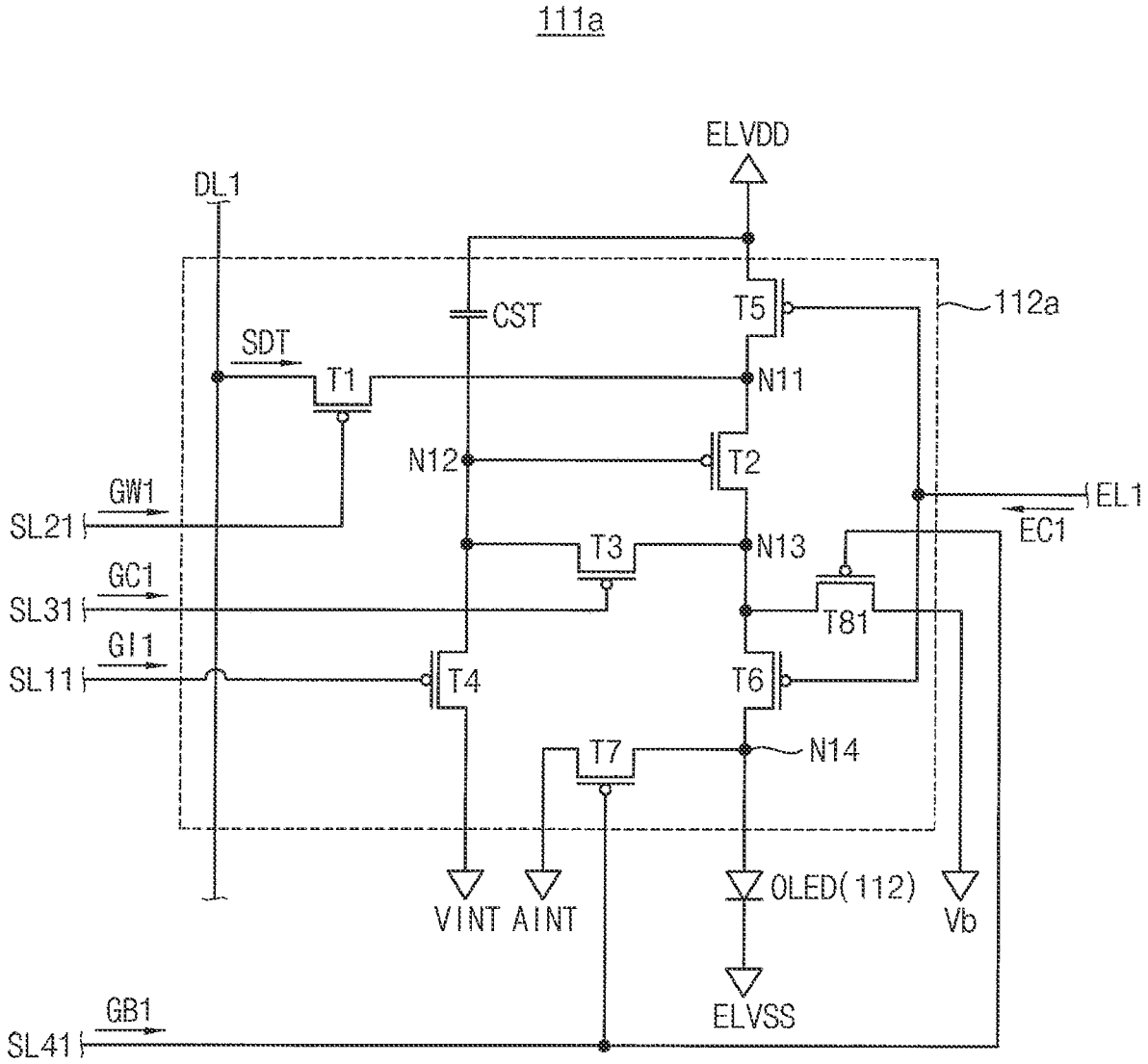
FIG. 4 is a circuit diagram of the pixel of FIG. 3 according to an example embodiment.

FIG. 4 is a circuit diagram of the pixel of FIG. 3 according to an example embodiment.

In FIG. 3, a pixel 111 is coupled to the a first scan line set SLS1, a first data line DL1, and a first emission control line ELL The first scan line set SLS1 includes a first scan line SL11, a second scan line SL21, a third scan line SL31, and a fourth scan line SL41.

Referring to FIG. 4, a pixel 111*a* may include a pixel circuit 112*a* and an OLED 112. The pixel circuit 112*a* may include a switching transistor T1, a driving transistor T2, a compensation transistor T3, a first initialization transistor T4, a second initialization transistor T7, a first emission transistor T5, a second emission transistor T6, a bias transistor T81, and a storage capacitor CST. Each of the switching transistor T1, the driving transistor T2, the compensation transistor T3, the first initialization transistor T4, the second initialization transistor T7, the first emission transistor T5, the second emission transistor T6, and the bias transistor T81 may be a p-type metal-oxide semiconductor (PMOS) transistor. However, the present disclosure is not limited thereto. For example, all or some of the transistors T1 through T7 may be an n-type metal-oxide semiconductor (NMOS) transistor without deviating from the scope of the present disclosure.

The switching transistor T1 may have a first electrode coupled to the data line DL1 to receive a data voltage SDT, a gate electrode coupled to the second scan line SL21 to receive a second scan signal GW1, and a second electrode coupled to a first node N11. The driving transistor T2 may have a first electrode coupled to the first node N11, a gate electrode coupled to a second node N12, and a second electrode coupled to a third node N13.

The compensation transistor T3 may have a gate electrode coupled to the third scan line SL31 to receive a third scan signal GC1, a first electrode coupled to the second node N12, and a second electrode coupled to the third node N13. The first initialization transistor T4 may have a gate coupled to the first scan line SL11 to receive a first scan signal GI1, a first electrode coupled to the second node N12, and a second electrode to receive the first initialization voltage VINT.

The first emission transistor T5 may have a first electrode to receive the high power supply voltage ELVDD, a second electrode coupled to the first node N11, and a gate electrode coupled to the first emission control line EL1 to receive a first emission control signal EC1. The second emission transistor T6 may have a first electrode coupled to the third node N13, a second electrode coupled to the fourth node N14, and a gate electrode coupled to the first emission control line EL1 to receive the first emission control signal EC1.

The second initialization transistor T7 may have a gate coupled to the fourth scan line SL41 to receive a fourth scan signal GB1, a first electrode to receive the second initialization voltage AINT, and a second electrode coupled to the fourth node N14. The bias transistor T81 may have a first electrode coupled to the third node N13, a second electrode to receive the bias voltage Vb, and a gate electrode coupled to the fourth scan line SL41 to receive the fourth scan signal GB1.

The storage capacitor CST may have a first terminal coupled to the high power supply voltage ELVDD and a second terminal coupled to the second node N12. The OLED 112 may have an anode coupled to the fourth node N14 and a cathode coupled to the low power supply voltage ELVSS.

The switching transistor T1 transfers the data voltage SDT to the storage capacitor CST in response to the second scan signal GW1, and the OLED 112 may emit light in response to the data voltage SDT stored in the storage capacitor CST to display an image.

The first and second emission transistors T5 and T6 are turned-on or turned-off in response to the first emission control signal EC1 to provide a current to the OLED 112 or to intercept a current from the OLED 112. When the current is intercepted from the OLED 112, the OLED 112 does not emit. Therefore, the first and second emission transistors T5 and T6 are turned on or turned off in response to the first emission control signal EC1 to adjust luminance of the pixel 111.

The compensation transistor T3 may connect the second node N12 and the third node N13 in response to the third scan signal GC1. That is, the compensation transistor T3 may compensate for variance of a threshold voltage of the driving transistor T2 of the pixel 111 by diode-connecting the gate electrode and the second electrode of the driving transistor T2.

The first initialization transistor T4 may transfer the first initialization voltage VINT to the second node N12 in response to the first scan signal GIL The first initialization transistor T4 may initialize the data voltage SDT transferred to the driving transistor T2 during a previous frame by transferring the first initialization voltage VINT to the gate electrode of the driving transistor T2.

The second initialization transistor T7 may transfer the second initialization voltage AINT to the fourth node N14 in response to the fourth scan signal GB1 to discharge parasitic capacitance between the second emission transistor T6 and the OLED 112. The bias transistor T81 may connect the third node N31 to the bias voltage Vb in response to the fourth scan signal GB1 to apply on-bias stress to the second electrode of the driving transistor T2. The bias transistor T81 may compensate for hysteresis characteristic of the driving transistor T2.

In some embodiments, the second initialization transistor T7 may connect the fourth node N14 to the first initialization voltage VINT instead of the second initialization voltage AINT in response to the second scan signal GW1 to discharge parasitic capacitance between the second emission transistor T6 and the OLED 112. The first scan signal GI1 may be applied to the gate electrode of the second initialization transistor T7 instead of the fourth scan signal GB1.

Figure 5:
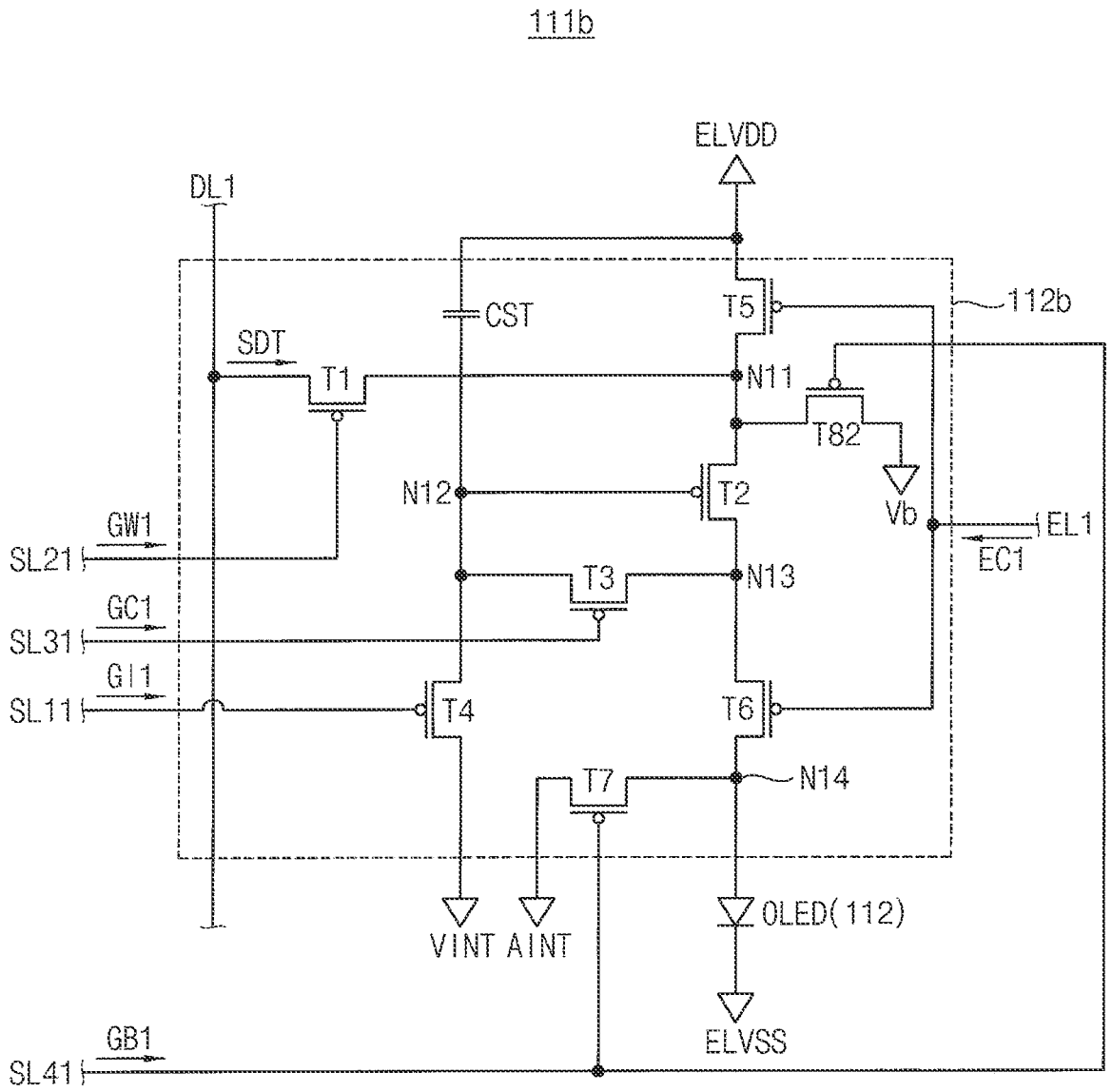
FIG. 5 is a circuit diagram illustrating another example of the pixel of FIG. 3 according to an example embodiment.

FIG. 5 is a circuit diagram illustrating another example of the pixel 111 of FIG. 3 according to an example embodiment.

Referring to FIG. 5, a pixel 111*b* may include a pixel circuit 112*b* and an OLED 112. The pixel circuit 112*b* may include a switching transistor T1, a driving transistor T2, a compensation transistor T3, a first initialization transistor T4, a second initialization transistor T7, a first emission transistor T5, a second emission transistor T6, a bias transistor T82, and a storage capacitor CST. The pixel circuit 112*b* differs from the pixel circuit 112*a* of FIG. 4 in that the bias transistor T82 (e.g., a PMOS transistor) has a first electrode coupled to the first node N11, a second electrode to receive the bias voltage Vb, and a gate electrode coupled to the fourth scan line SL41 to receive the fourth scan signal GB1. The bias transistor T82 may connect the first node N11 to the bias voltage Vb in response to the fourth scan signal GB1 to apply on-bias stress to the first electrode of the driving transistor T2. The bias transistor T82 may compensate for hysteresis characteristic of the driving transistor T2.

Figure 6:
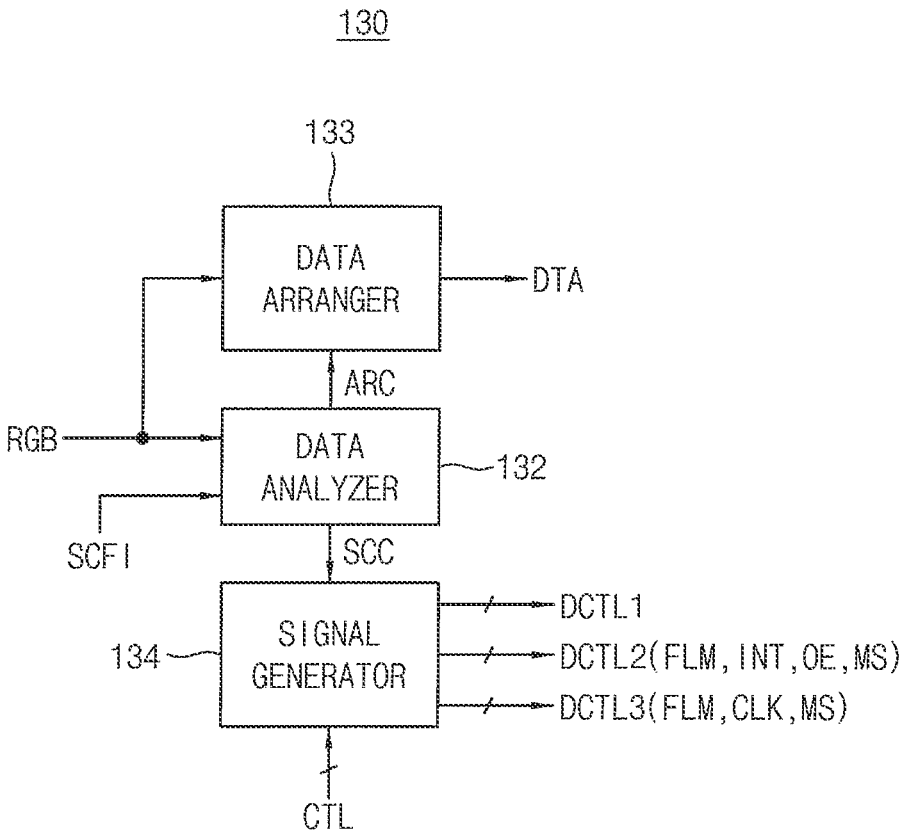
FIG. 6 is a block diagram illustrating the timing controller in the OLED display device of FIG. 1.

FIG. 6 is a block diagram illustrating the timing controller 130 in the OLED display device 100 of FIG. 1.

Referring to FIG. 6, the timing controller 130 may include a data analyzer 132, a data arranger 133, and a signal generator 134.

The data analyzer 132 generates an arrangement control signal ARC and a scan control signal SCC based on the input image data RGB and scan driver configuration information SCFI. The data analyzer 132 may provide the arrangement control signal ARC to the data arranger 133 and the scan control signal SCC to the signal generator 134. The data analyzer 132 may analyze grey levels of the input image data RGB per each data line to generate the arrangement control signal ARC and may generate the scan control signal SCC based on the scan driver configuration information SCFI including configuration information of the scan driver 200. The scan driver configuration information SCFI may include information regarding the number of scan drivers (e.g., one, two) included in the scan driver 200. Referring to FIG. 1, the scan driver configuration information SCFI may be included in the control signal CTL.

The data arranger 133 arranges or rearranges the input image data RGB according to the arrangement control signal ARC and outputs the data signal DTA.

The signal generator 134 may generate the first driving control signal DCTL1 that controls the data driver 150, the second driving control signal DCTL2 that controls the scan driver 200, and the third driving control signal DCTL3 that controls the emission driver 300 based on the control signal CTL and the scan control signal SCC. The signal generator 134 may also generate the power control signal PCTL that controls the power supply 180, in response to the control signal CTL. The second driving control signal DCTL2 may include a starting signal FLM (frame line mark), an initialization signal INT, an output enable signals OE, and a mode signal MS associated with a scan mode. The third driving control signal DCTL3 may include the starting signal FLM, a clock signal CLK, and the mode signal MS.

Figure 7:
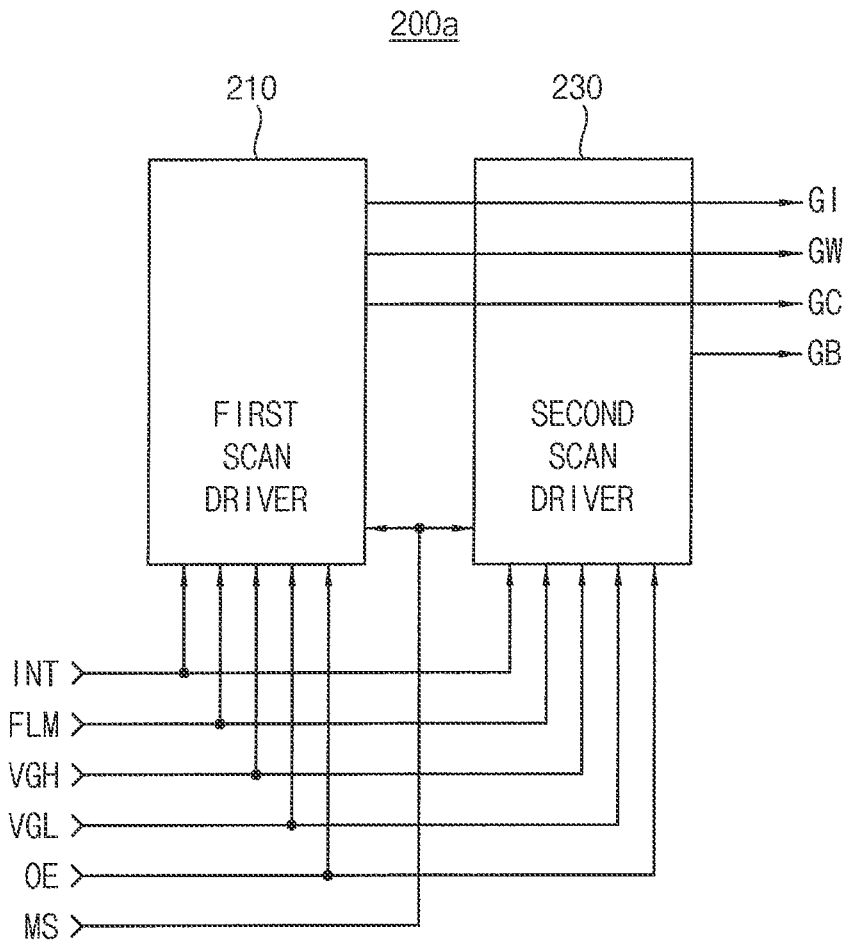
FIG. 7 is a block diagram illustrating an example of the scan driver in the OLED display device of FIG. 1 according to an example embodiment.

FIG. 7 is a block diagram illustrating an example of the scan driver in the OLED display device 100 of FIG. 1 according to an example embodiment.

Referring to FIG. 7, a scan driver 200*a* may include a first scan driver 210 and a second scan driver 230.

The first scan driver 210 may receive the initialization signal INT, the starting signal FLM, the first voltage VGH, the second voltage VGL, the output enable signal OE, and the mode signal MS, may generate the first scan signal GI (e.g., GI1 of FIG. 4), the second scan signal GW (e.g., GW1 of FIG. 4), and the third scan signal GC (e.g., GC1 of FIG. 4) based on the initialization signal INT, the starting signal FLM, the first voltage VGH, the second voltage VGL, the output enable signal OE, and the mode signal MS, and may determine scan-on time of each of the first scan signal GI, the second scan signal GW, and the third scan signal GC. The second scan driver 230 may receive the initialization signal INT, the starting signal FLM, the first voltage VGH, the second voltage VGL, the output enable signal OE, and the mode signal MS, may generate the fourth scan signal GB based on the initialization signal INT, the starting signal FLM, the first voltage VGH, the second voltage VGL, the output enable signal OE, and the mode signal MS, and may determine scan-on time of the fourth scan signal GB.

Figure 8:
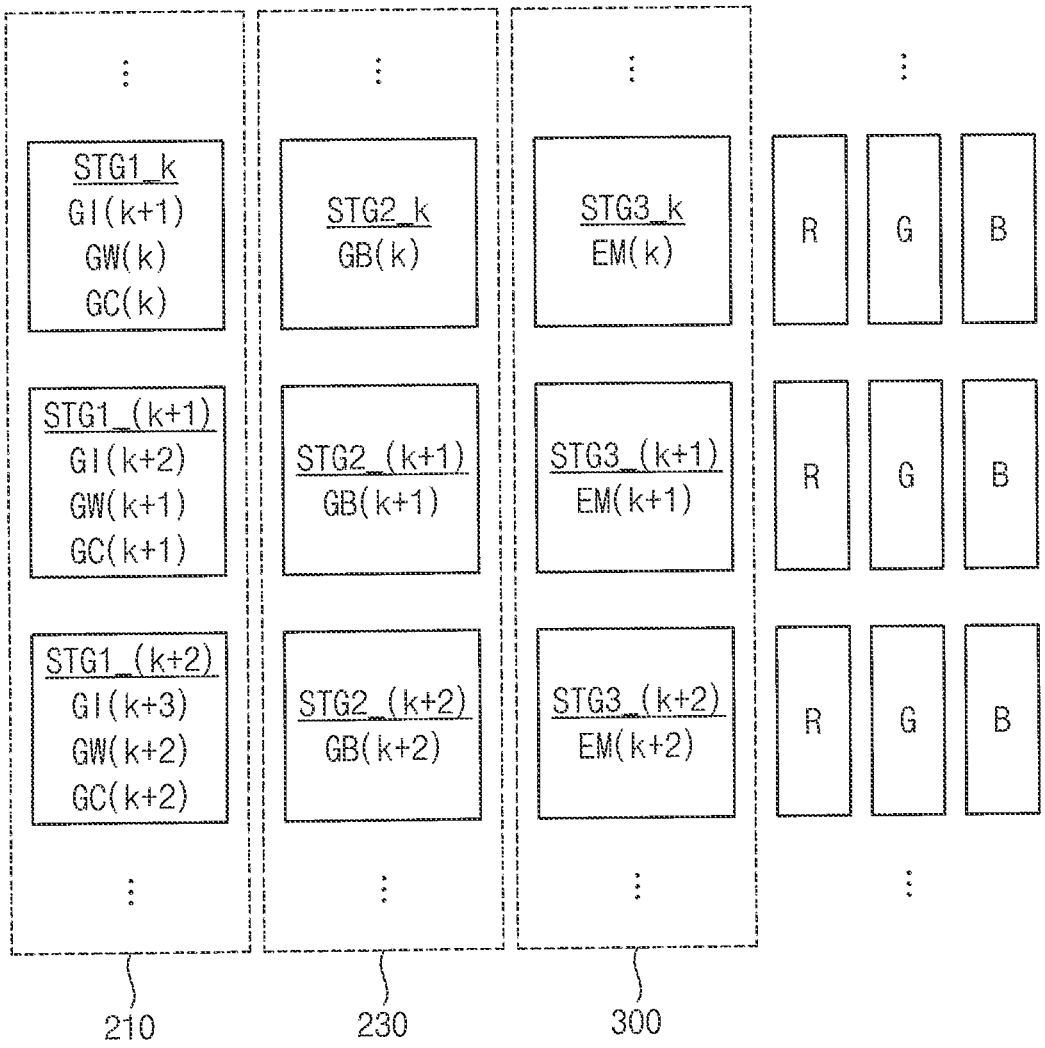
FIG. 8 is a block diagram illustrating the scan driver of FIG. 7 and the emission driver in FIG. 1.

FIG. 8 is a block diagram illustrating the scan driver 200*a* of FIG. 7 and the emission driver 300 in FIG. 1.

FIG. 8 shows some stages of a plurality of stages in the first scan driver 210 and the second scan driver 230 and some stages of a plurality of stages in the emission driver 300 for convenience of explanation.

Referring to FIG. 8, the first scan driver 210 may include stages STG1_*k*, STG1_(k+1), and STG1_(k+2), the second scan driver 230 may include stages STG2_*k*, STG2_(k+1), and STG2_(k+2), and the emission driver 300 may include stages STG3_*k*, STG3_(k+1), and STG3_(k+2). Here, k is a natural number and may be one of 1 to n.

Each of the stages STG2_*k*, STG2_(k+1) and STG2_(k+2) in the second scan driver 230 may generate a respective one of fourth scan signals GB(k), GB(k+1), and GB(k+2) associated with corresponding pixel rows of the pixels 111 in FIG. 1, and each of the STG3_*k*, STG3_(k+1) and STG3_(k+2) in the emission driver 300 may generate a respective one of emission control signals EM(k), EM(k+1), and EM(k+2) associated with corresponding pixel rows of the pixels 111 in FIG. 1.

The stage STG1_*k* in the first scan driver 210 may generate a first scan signal GI(k+1) associated with a (k+1)-th pixel row, a second scan signal GW(k) associated with a k-th pixel row, and a third scan signal GC(k) associated with the k-th pixel row. The stage STG1_(k+1) in the first scan driver 210 may generate a first scan signal GI(k+2) associated with a (k+2)-th pixel row, a second scan signal GW(k+1) associated with the (k+1)-th pixel row, and a third scan signal GC(k+1) associated with the (k+1)-th pixel row. The stage STG1_(k+2) in the first scan driver 210 may generate a first scan signal GI(k+3) associated with a (k+3)-th pixel row, a second scan signal GW(k+2) associated with the (k+2)-th pixel row, and a third scan signal GC(k+2) associated with the (k+2)-th pixel row.

The first scan driver 210 may merge circuits associated with the second scan signal GW and the third scan signal GC, or may merge circuits associated with the first scan signal GI, the second scan signal GW, and the third scan signal GC. Therefore, an occupied area by the first scan driver 210 may be reduced.

In FIG. 8, R, G and B represent pixels displaying corresponding colors of red, green, and blue, respectively.

Figure 9:
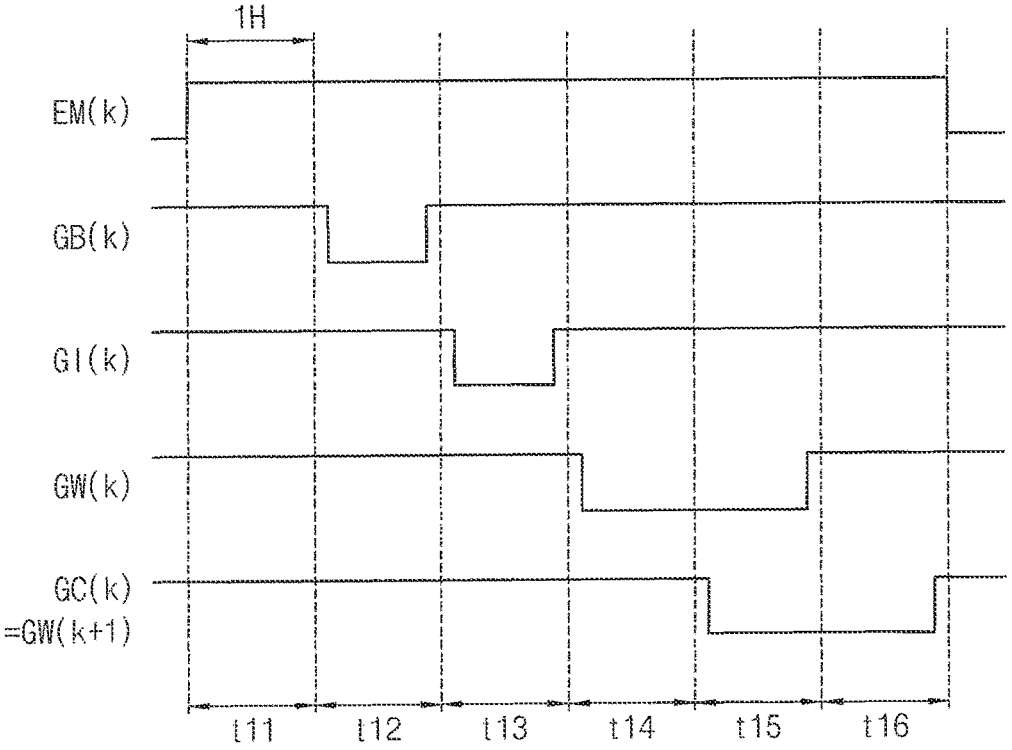
FIG. 9, FIG. 10, and FIG. 11 are timing diagrams of the scan driver in FIG. 7 according to an example embodiment.
Figure 10:
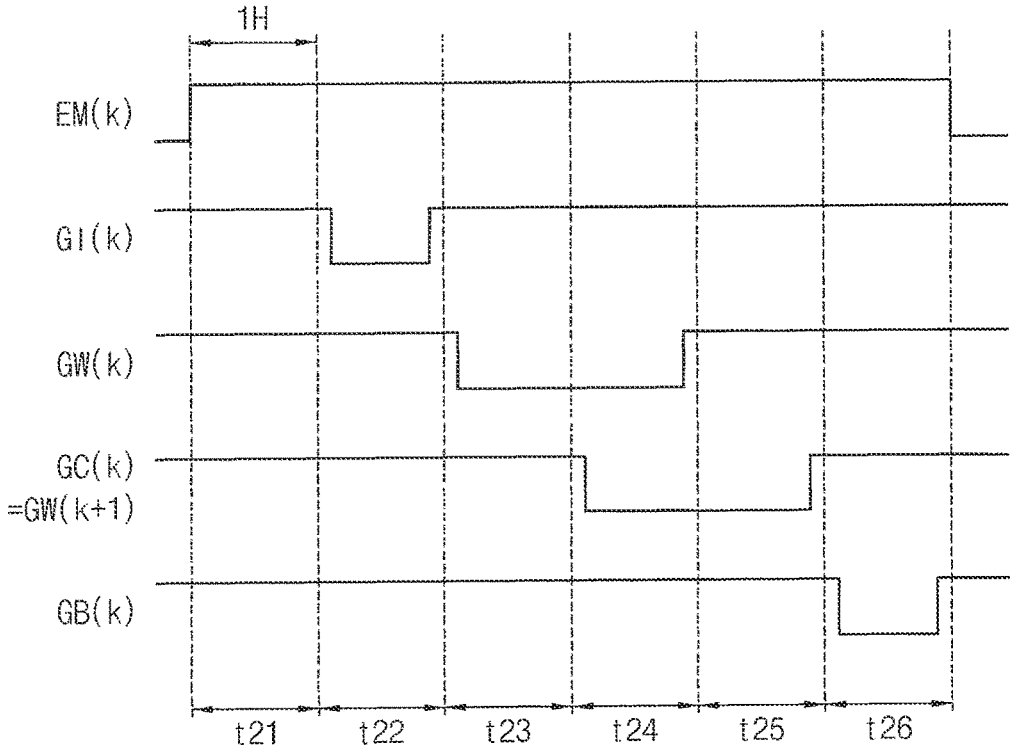
Figure 11:
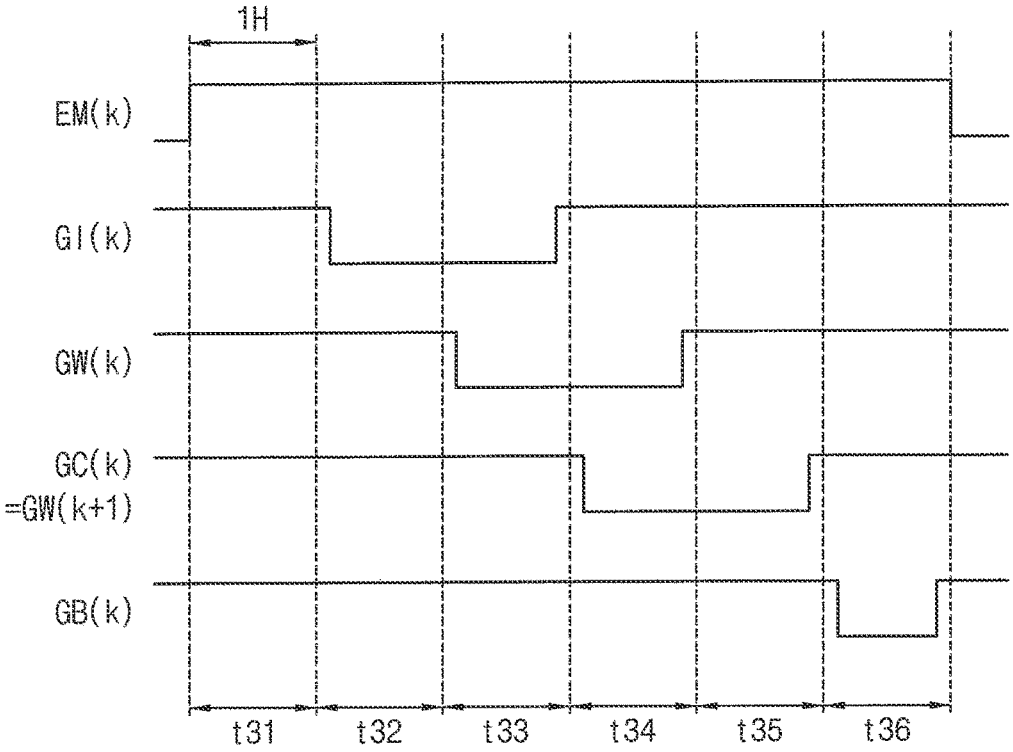

FIGS. 9 through 11 are timing diagrams of the scan driver 200*a* in FIG. 7 according to an example embodiment.

In FIGS. 9 through 11, the emission control signal EM(k) is also illustrated for convenience of explanation.

In FIG. 9 through 11, the emission driver 300 may disable the emission control signal EM(k) with a logic high level during a non-emission interval. The non-emission interval may include consecutive first through sixth horizontal periods t11~t16, t21~t26, and t31~t36, and each horizontal period in the consecutive first through sixth horizontal periods t11~t16, t21~t26, and t31~t36 may correspond to one horizontal period 1H. The emission driver 300 may apply the emission control signal EM(k) to the first and second emission transistors T5 and T6 in the k-th pixel row. The scan driver 200*a* may apply the first scan signal GI(k) to the first initialization transistor T4 in the k-th pixel row, may apply the second scan signal GW(k) to the switching transistor T1 in the k-th pixel row, may apply the third scan signal GC(k) to the compensation transistor T3 in the k-th pixel row, and may apply the fourth scan signal GB(k) to the second initialization transistor T7 and the bias transistor T8 in the k-th pixel row. The scan driver 200*a* may enable the first, second, third, and fourth scan signals GI(k), GW(k), GC(k), and GB(k) with a logic low level.

Referring to FIG. 9, the scan driver 200*a* may enable the fourth scan signal GB(k) during the second horizontal period t12, may enable the first scan signal GI(k) during the third horizontal period t13, may enable the second scan signal GW(k) during the fourth and fifth horizontal periods t14 and t15, and may enable the third scan signal GC(k) during the fifth and sixth horizontal periods t15 and t16. Enablement of the second scan signal GW(k) and the third scan signal GC(k) are partially overlapped during the fifth horizontal period t15, and the second scan signal GW(k) and the third scan signal GC(k) are enabled two consecutive horizontal periods. Therefore, the scan driver 200*a* may increase scan-on time of the second scan signal GW(k) and the third scan signal GC(k) to reduce crosstalk and low gray-level staining. In addition, the scan driver 200*a* may use the third scan signal GC(k) for the k-th pixel row as the second scan signal GW(k+1) for the (k+1)-th pixel row.

Because the second scan signal GW(k) and the third scan signal GC(k) are driven during two consecutive horizontal periods 2H, the data voltage SDT may be sufficiently stored in the storage capacitor CST based on the second scan signal GW(k), and variance of a threshold voltage of the driving transistor T2 may be sufficiently compensated based on the third scan signal GC(k).

Referring to FIG. 10, the scan driver 200*a* may enable the first scan signal GI(k) during the second horizontal period t22, may enable the second scan signal GW(k) during the third and fourth horizontal periods t23 and t24, may enable the third scan signal GC(k) during the fourth and fifth horizontal periods t24 and t25, and may enable the fourth scan signal GB(k) during the sixth horizontal period t26. Enablement of the second scan signal GW(k) and the third scan signal GC(k) are partially overlapped during the fourth horizontal period t24, and the second scan signal GW(k) and the third scan signal GC(k) are enabled two consecutive horizontal periods. Therefore, the scan driver 200*a* may increase scan-on time of the second scan signal GW(k) and the third scan signal GC(k) to reduce crosstalk and low gray-level staining.

Referring to FIG. 11, the scan driver 200*a* may enable the first scan signal GI(k) during the second and third horizontal periods t32 and t33, may enable the second scan signal GW(k) during the third and fourth horizontal periods t33 and t34, may enable the third scan signal GC(k) during the fourth and fifth horizontal periods t34 and t35, and may enable the fourth scan signal GB(k) during the sixth horizontal period t36. Enablement of the first scan signal GI(k) and the second scan signal GW(k) are partially overlapped during the third horizontal period t33, and the first scan signal GI(k) and the second scan signal GW(k) are enabled two consecutive horizontal periods. Enablement of the second scan signal GW(k) and the third scan signal GC(k) are partially overlapped during the fourth horizontal period t34, and the second scan signal GW(k) and the third scan signal GC(k) are enabled two consecutive horizontal periods. Therefore, the scan driver 200*a* may increase scan-on time of the first scan signal GI(k), the second scan signal GW(k), and the third scan signal GC(k) to reduce crosstalk and low gray-level staining.

Figure 12:
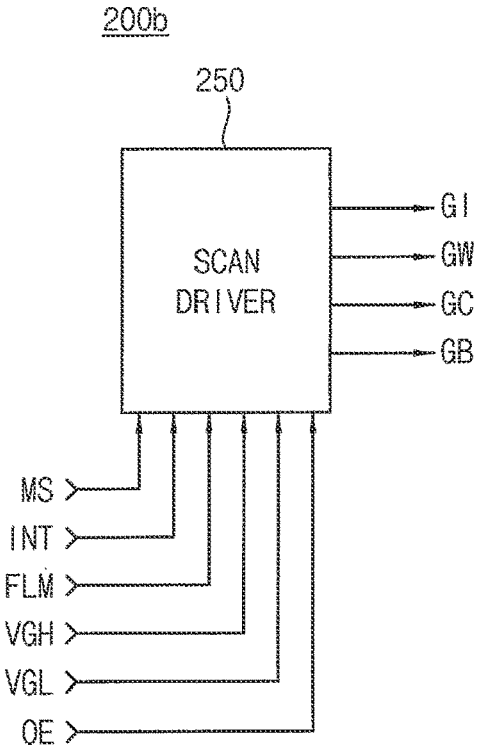
FIG. 12 is a block diagram illustrating an example of the scan driver in the OLED display device of FIG. 1 according to an example embodiment.

FIG. 12 is a block diagram illustrating an example of the scan driver in the OLED display device 100 of FIG. 1 according to an example embodiment.

Referring to FIG. 12, a scan driver 200*b* may include a scan driver 250.

The scan driver 250 may receive the initialization signal INT, the starting signal FLM, the first voltage VGH, the second voltage VGL, the output enable signal OE, and the mode signal MS, may generate the first scan signal GI, the second scan signal GW, the third scan signal GC, and the fourth scan signal GB based on the initialization signal INT, the starting signal FLM, the first voltage VGH, the second voltage VGL, the output enable signal OE, and the mode signal MS, and may determine scan-on timeof each of the first scan signal GI, the second scan signal GW, the third scan signal GC, and the fourth scan signal GB.

Figure 13:
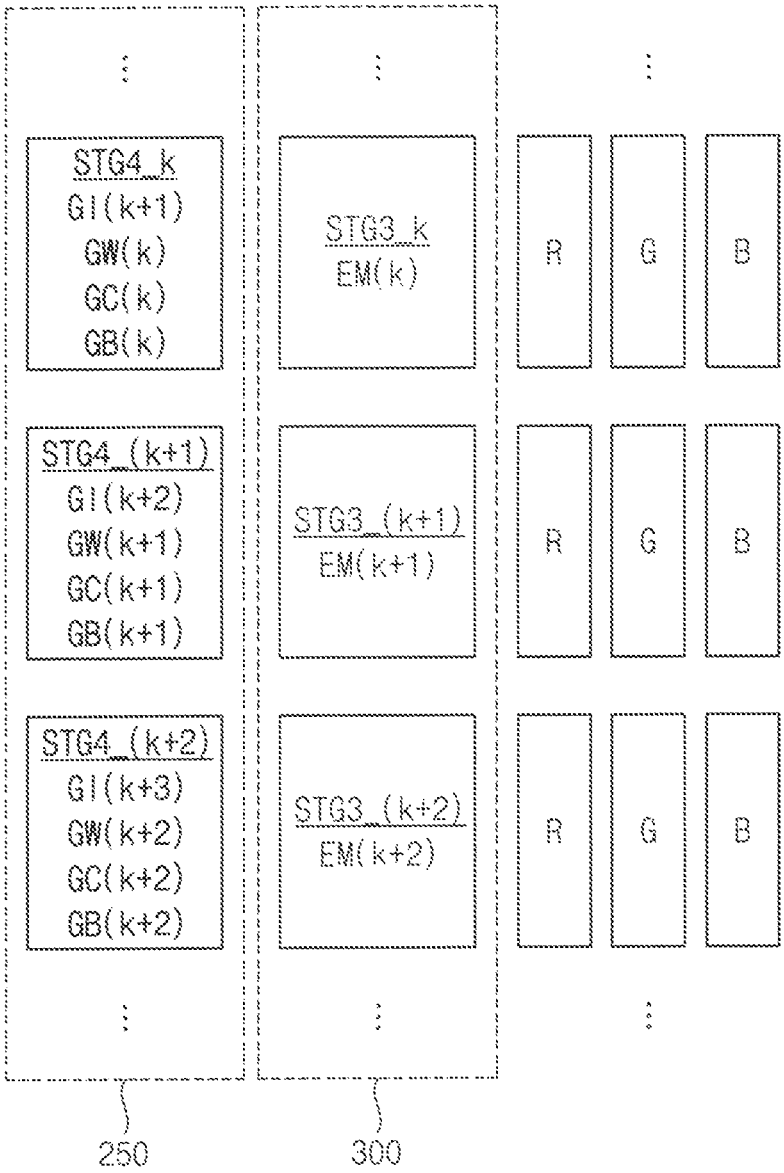
FIG. 13 is a block diagram illustrating the scan driver of FIG. 12 and the emission driver in FIG. 1.

FIG. 13 is a block diagram illustrating the scan driver 200*b* of FIG. 12 and the emission driver 300 in FIG. 1.

FIG. 13 shows some stages of a plurality of stages in the scan driver 250 and some stages of a plurality of stages in the emission driver 300 in FIG. 1 for convenience of explanation. The stages STG3_*k*, STG3_(k+1), and STG3_(k+2) in the emission driver 300 are described with reference to FIG. 8 and thus, description on the stages STG3_*k*, STG3_(k+1), and STG3_(k+2) in the emission driver 300 will be omitted.

Referring to FIG. 13, the scan driver 250 may include stages STG4_*k*, STG4_(k+1) and STG4_(k+2). The stage STG4_*k* in the scan driver 250 may generate the first scan signal GI(k+1) associated with a (k+1)-th pixel row, the second scan signal GW(k) associated with a k-th pixel row, the third scan signal GC(k) associated with the k-th pixel row, and the fourth scan signal GB(k) associated with the k-th pixel row. The stage STG4_(k+1) in the scan driver 250 may generate the first scan signal GI(k+2) associated with a (k+2)-th pixel row, the second scan signal GW(k+1) associated with the (k+1)-th pixel row, the third scan signal GC(k+1) associated with the (k+1)-th pixel row, and the fourth scan signal GB(k+1) associated with the (k+1)-th pixel row. The stage STG4_(k+2) in the scan driver 250 may generate the first scan signal GI(k+3) associated with a (k+3)-th pixel row, a second scan signal GW(k+2) associated with the (k+2)-th pixel row, the third scan signal GC(k+2) associated with the (k+2)-th pixel row, and the fourth scan signal GB(k+2) associated with the (k+2)-th pixel row.

The scan driver 250 may merge circuits associated with the first through fourth scan signals GI, GW, GC, and GB. Therefore, an occupied area by the scan driver 250 may be reduced. In FIG. 13, R, G and B represent pixels displaying corresponding colors of red, green, and blue, respectively.

Figure 14:
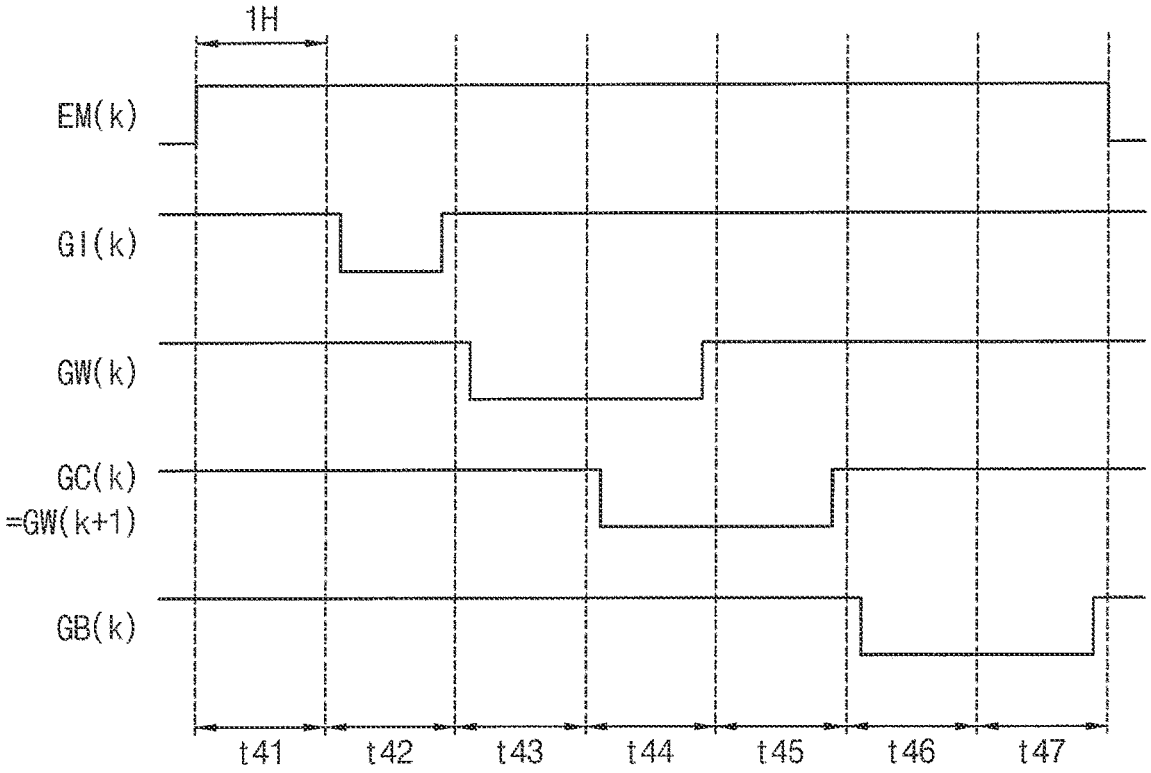
FIG. 14 and FIG. 15 illustrate that the scan driver in FIG. 12 drives the scan lines, respectively.
Figure 15:
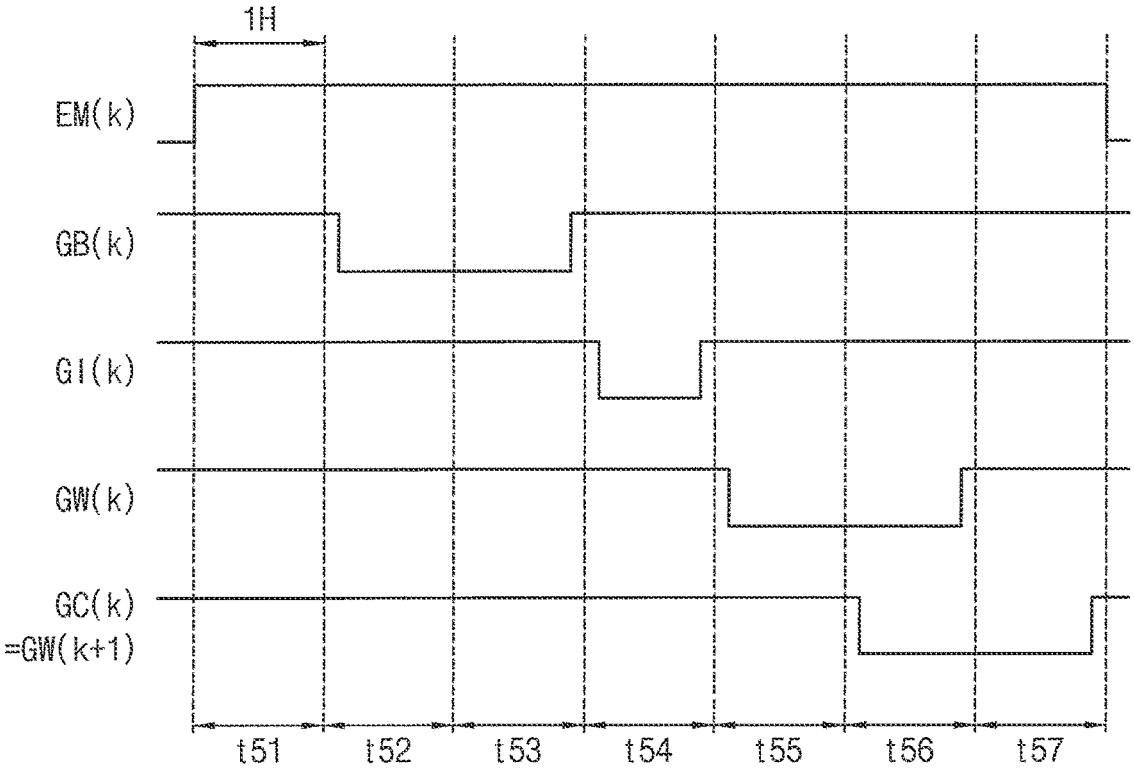

FIGS. 14 and 15 illustrate that the scan driver 200*b* in FIG. 12 drives the scan lines, respectively.

In FIGS. 14 and 15, the emission control signal EM(k) is also illustrated for convenience of explanation.

In FIGS. 14 and 15, the emission driver 300 may disable the emission control signal EM(k) with a logic high level during a non-emission interval. The non-emission interval may include consecutive first through seventh horizontal periods t41~t47 and t51~t57, and each horizontal period in the consecutive first through seventh horizontal periods t41~t47 and t51~t57 may correspond to one horizontal period 1H. The emission driver 300 may apply the emission control signal EM(k) to the first and second emission transistors T5 and T6 in the k-th pixel row. The scan driver 200*b* may apply the first scan signal GI(k) to the first initialization transistor T4 in the k-th pixel row, may apply the second scan signal GW(k) to the switching transistor T1 in the k-th pixel row, may apply the third scan signal GC(k) to the compensation transistor T3 in the k-th pixel row, and may apply the fourth scan signal GB(k) to the second initialization transistor T7 and the bias transistor T8 in the k-th pixel row. The scan driver 200*b* may enable the first, second, third, and fourth scan signals GI(k), GW(k), GC(k), and GB(k) with a logic low level.

Referring to FIG. 14, the scan driver 200*b* may enable the first scan signal GI(k) during the second horizontal period t42, may enable the second scan signal GW(k) during the third and fourth horizontal periods t43 and t44, may enable the third scan signal GC(k) during the fourth and fifth horizontal periods t44 and t45, and may enable the fourth scan signal GB(k) during the sixth and seventh horizontal periods t46 and t47. Enablement of the second scan signal GW(k) and the third scan signal GC(k) are partially overlapped during the fourth horizontal period t44, and the second scan signal GW(k) and the third scan signal GC(k) are enabled two consecutive horizontal periods. Therefore, the scan driver 200*b* may increase scan-on timeof the second scan signal GW(k) and the third scan signal GC(k) to reduce crosstalk and low gray-level staining. In addition, the scan driver 200*b* may use the third scan signal GC(k) for the k-th pixel row as the second scan signal GW(k+1) for the (k+1)-th pixel row.

Referring to FIG. 15, the scan driver 200*b* may enable the fourth scan signal GB(k) during the second and third horizontal period t52 and t53, may enable the first scan signal GI(k) during the fourth horizontal period t54, may enable the second scan signal GW(k) during the fifth and sixth horizontal periods t55 and t56, and may enable the third scan signal GC(k) during the sixth and seventh horizontal periods t56 and t57. Enablement of the second scan signal GW(k) and the third scan signal GC(k) are partially overlapped during the sixth horizontal period t56, and the second scan signal GW(k) and the third scan signal GC(k) are enabled two consecutive horizontal periods. Therefore, the scan driver 200*b* may increase scan-on timeof the second scan signal GW(k) and the third scan signal GC(k) to reduce crosstalk and low gray-level staining.

Figure 16:
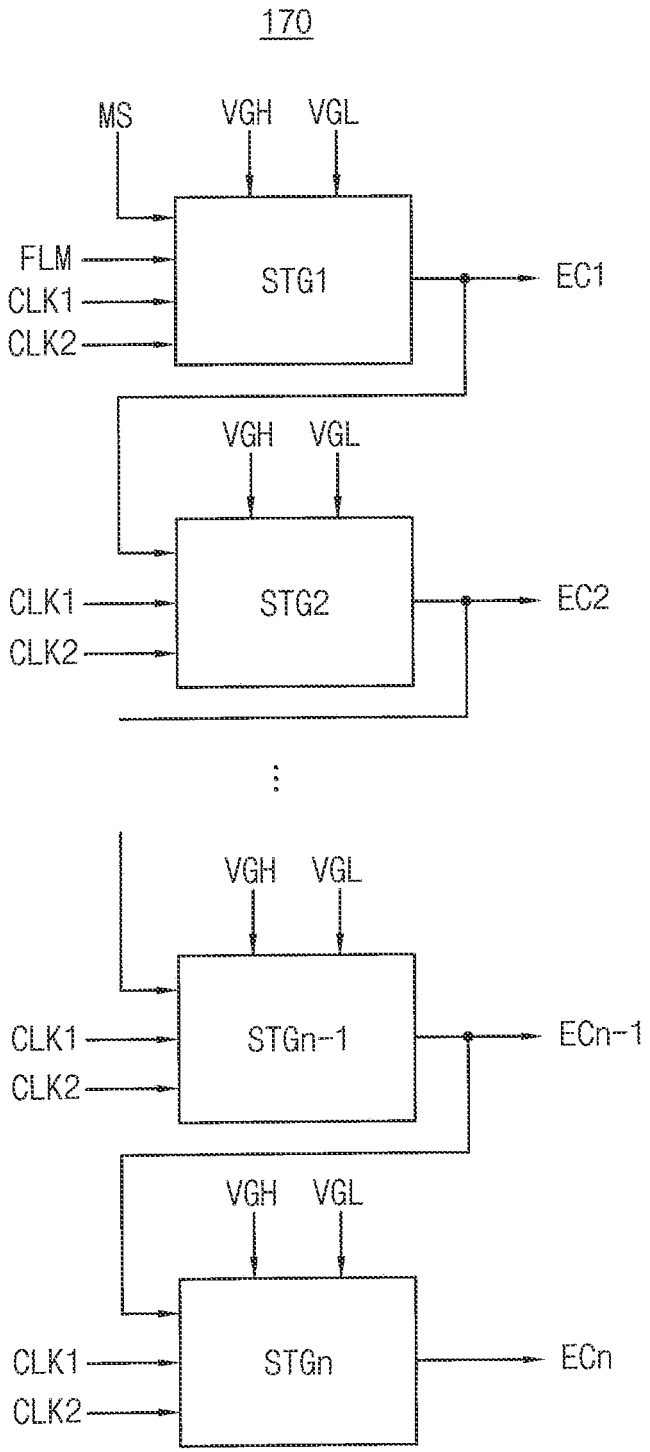
FIG. 16 is a block diagram illustrating an emission driver of the OLED display device shown in FIG. 1 according to an example embodiment.

FIG. 16 is a block diagram illustrating an emission driver of the OLED display device 100 shown in FIG. 1 according to an example embodiment.

Referring to FIG. 16, an emission driver 170 may include a plurality of stages STG1~STGn connected one after another to sequentially output the emission control signals EC1~ECn.

The stages STG1~STGn are respectively connected to the emission control lines EL1~ELn and sequentially output the emission control signals EC1~ECn. The emission control signals EC1~ECn may overlap each other during a predetermined period.

Each of the stages STG1~STGn receives the first voltage VGH and the second voltage VGL that has a voltage level lower than that of the first voltage VGH. In addition, each of the stages STG1~STGn receives a first clock signal CLK1 and a second clock signal CLK2, and some of the stages STG1~STGn receive the starting signal FLM and/or the mode signal MS. The mode signal MS may determine a number of horizontal periods included in the non-emission interval and a time interval of the non-emission interval.

Hereinafter, the emission control signals EC1~ECn output through the emission control lines EL1~ELn are referred to as first to n-th emission control signals.

Among the stages STG1~STGn, a first stage STG1 is driven in response to the starting signal FLM. In detail, the first stage STG1 receives the first voltage VGH and the second voltage VGL and generates the first emission control signal EC1 in response to the starting signal FLM, the first clock signal CLK1, the second clock signal CLK2, and the mode signal MS. The first emission control signal EC1 is applied to the pixels 111 in the first pixel row through the first emission control line EL1.

The stages STG1~STGn are connected to one after another and are sequentially driven. For example, a present stage is connected to an output electrode of a pervious stage except the first stage STG1 and receives the emission control signal EC output from the previous stage. The present stage is driven in response to the emission control signal EC provided from the previous stage.

For example, the second stage STG2 may receive the first emission control signal EC1 that is output from the first stage STG1 and is driven in response to the first emission control signal EC1. The second stage STG2 also receives the first voltage VGH and the second voltage VGL and generates the second emission control signal EC2 in response to the first emission control signal EC1, the first clock signal CLK1, and the second clock signal CLK2. The second emission control signal EC2 is applied to the pixels 111 in the second pixel row through the second emission control line EL2. The other stages STG3 to STGn are driven in the same way as the second stage STG2, and thus details thereof will not be repeated.

Figure 17:
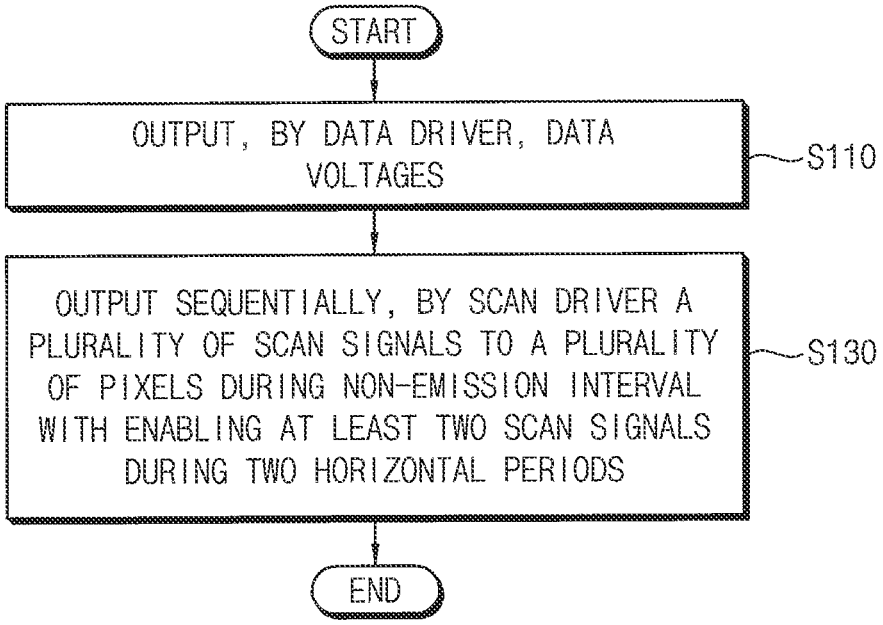
FIG. 17 is a flow chart illustrating a method of driving an OLED display device according to an example embodiment.

FIG. 17 is a flow chart illustrating a method of driving an OLED display device according to an example embodiment.

FIGS. 1 through 17 provides a method of driving the OLED display device 100 that includes the display panel 110 having the plurality of pixels 111. The method includes outputting data voltages to the plurality of pixels 111, by a data driver 150 connected to the display panel 110 through a plurality of data lines DL1~DLm (operation S110), and sequentially outputting a plurality of scan signals GI, GW, GC, and GB to the plurality of pixels 111, by a scan driver 200 connected to the display panel 110 through a plurality of scan line sets SLS1~SLSn (operation S130).

The scan driver 200 may enable at least two scan signals of the plurality of scan signals GI, GW, GC, and GB during a non-emission interval in which the pixels 111 do not emit light such that enabling of at least two scan signals are partially overlapped during two consecutive horizontal periods.

Figure 18:
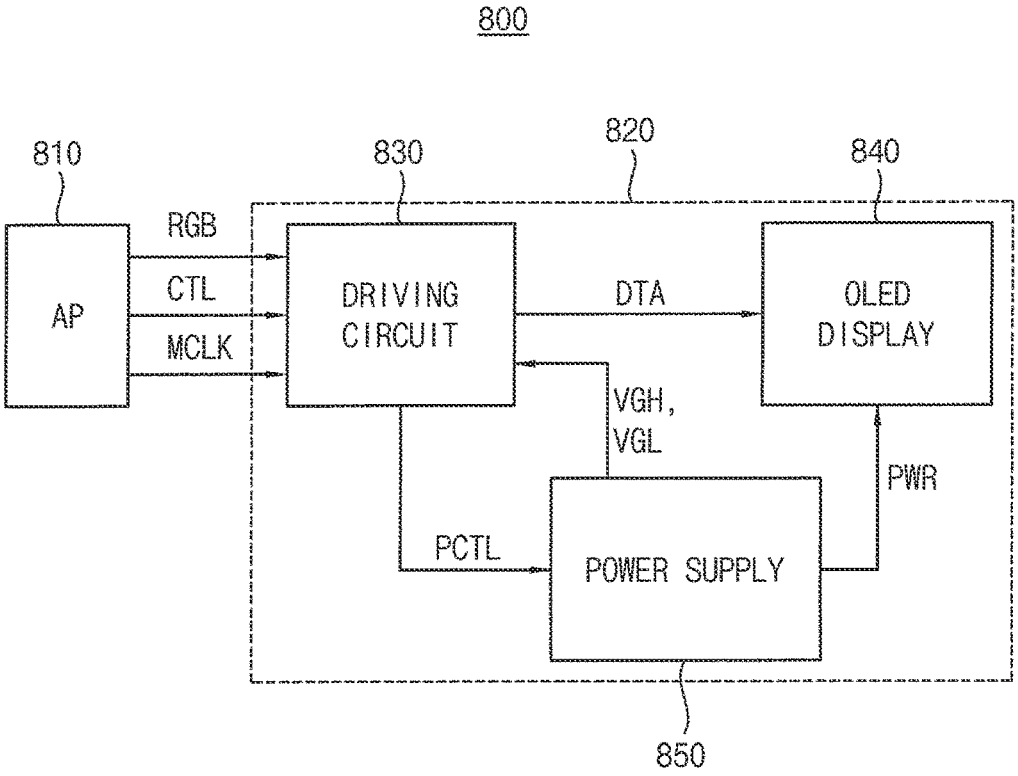
FIG. 18 is a block diagram illustrating a display system according to an example embodiment.

FIG. 18 is a block diagram illustrating a display system according to an example embodiments.

Referring to FIG. 18, a display system 800 may include an application processor 810 and an OLED display device 820. The OLED display device 820 may include a driving circuit 830, a display panel (OLED display) 840, and a power supply 850.

The power supply 850 may provide a power PWR to the display panel 840 in response to a power control signal PCTL receive from the driving circuit 830. The power PWR may include the high power supply voltage ELVDD, the low power supply voltage ELVSS, the first initialization voltage VINT, the second initialization voltage AINT, and the bias voltage Vb as illustrated in FIGS. 1 and 4. The power supply 850 may provide the first voltage VGH and the second voltage VGL to the driving circuit 830.

The display system 800 may be a portable device such as a laptop computer, a cellular phone, a smartphone, a personal computer (PC), a personal digital assistant (PDA), a portable multi-media player (PMP), a MP3 player, a navigation system, etc.

The application processor 810 provides an image signal RGB, a control signal CTL, and a main clock signal MCLK to the OLED display device 820, and the driving circuit 830 may provide data DTA to the display panel 840.

The driving circuit 830, the display panel 840, and the power supply 850 may be substantially same as the driving circuit 105, the display panel 110, and the power supply 180 shown in FIG. 1.

Figure 19:
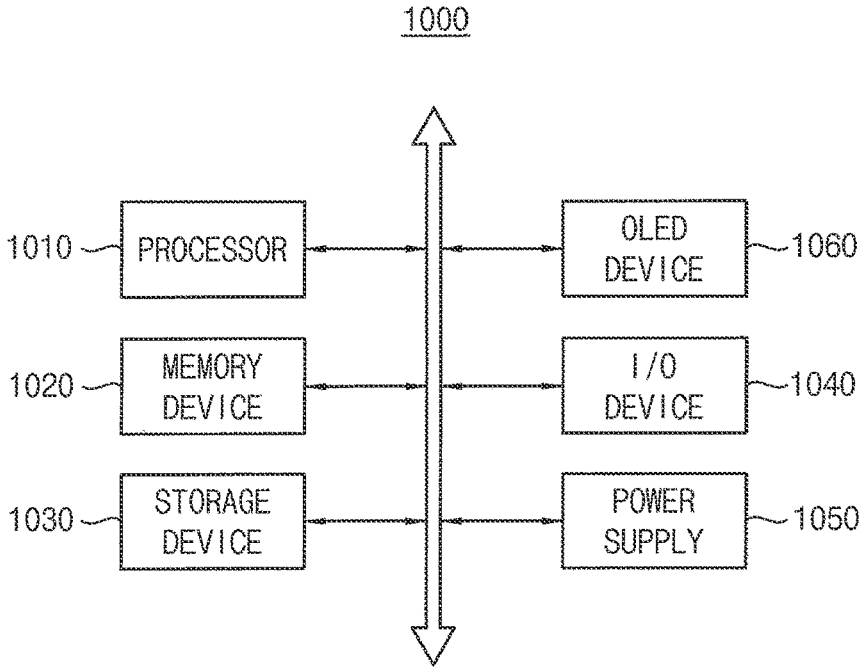
FIG. 19 is a block diagram illustrating an electronic device including an OLED display device according to an example embodiment.

FIG. 19 is a block diagram illustrating an electronic device including an OLED display device according to an example embodiment.

Referring to FIG. 19, an electronic device 1000 includes a processor 1010, a memory device 1020, a storage device 1030, an input/output (I/O) device 1040, a power supply 1050, and an OLED display device 1060. The electronic device 1000 may further include a plurality of ports for communicating with a video card, a sound card, a memory card, a universal serial bus (USB) device, and other electronic systems, devices, and components, etc.

The processor 1010 may perform various computing tasks. The processor 1010 may be, for example, a microprocessor, a central processing unit (CPU), etc. The processor 1010 may be connected to other components via an address bus, a control bus, a data bus, etc.

Further, the processor 1010 may be coupled to an extended bus such as a peripheral component interconnection (PCI) bus.

The memory device 1020 may store data for operating the electronic system 1000. For example, the memory device 1020 may include at least one non-volatile memory device such as a flash memory device and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc., and/or an output device such as a printer, a speaker, etc. The power supply 1050 may supply power for operating the electronic system 1000. The OLED display device 1060 may communicate with other components via the buses or other communication links.

The OLED display device 1060 may employ the OLED display device 100 of FIG. 1. Therefore, the OLED display device 1060 may include a driving circuit and a display panel, and the driving circuit may include a data driver and a scan driver. The scan driver may enable at least two scan signals of a plurality of scan signals during a non-emission interval in which pixels do not emit light such that enabling of at least two scan signals are partially overlapped during two consecutive horizontal periods. Therefore, the scan driver may reduce crosstalk and low gray-level staining for the OLED display device 1060 driven with a high frequency.

The electronic device 1000 may be a mobile electronic device including the OLED display device 1060 such as a smartphone.

The present embodiments may be applied to any electronic device 1000 having the OLED display device 1060. For example, the present embodiments may be applied to the electronic device 1000, such as a television, a computer monitor, a laptop computer, a digital camera, a cellular phone, a smartphone, a personal digital assistant (PDA), a portable multimedia player (PMP), a MP3 player, a navigation system, etc.

The present inventive concept may be applied to any display device or any electronic device including a display device displaying an image.

The foregoing is illustrative of example embodiments and is not to be construed as limiting thereof. Although several example embodiments have been described, those skilled in the art will readily appreciate that many modifications are possible in the example embodiments without materially departing from the novel teachings and advantages of the present inventive concept. Accordingly, modifications are intended to be included within the scope of the present inventive concept. Therefore, it is to be understood that the foregoing is illustrative of various example embodiments of the present inventive concepts and is not to be construed as limited to the specific example embodiments disclosed, and that modifications to the disclosed example embodiments, as well as other example embodiments, are intended to be included within the scope of the present disclosure including the appended claims.

What is claimed is:

1. A display device comprising:

a display panel including a plurality of pixels;

a driving circuit connected to the plurality of pixels through a plurality of scan line sets and a plurality of data lines, the driving circuit being configured to provide a plurality of scan signals to the display panel and provide data voltages to the plurality of data lines; and a power supply configured to apply one or more power voltages to the plurality of pixels, wherein the driving circuit includes a scan driver configured to enable at least two scan signals of the plurality of scan signals including a first scan signal, a second scan signal, a third scan signal, and a fourth scan signal, which are applied to each of pixel rows of the plurality of pixels during a non-emission interval, partially overlapping the at least two scan signals during at least two consecutive horizontal periods, and wherein a horizontal period corresponds to a period in which the driving circuit provides the data voltages to a pixel row of the plurality of pixels.

2. The display device of claim 1, wherein the driving circuit further includes:

a data driver configured to provide the data voltages corresponding to a data signal to the plurality of data lines connected to the plurality of pixels;

an emission driver configured to provide emission control signals to a plurality emission control lines connected to the plurality of pixels; and a timing controller configured to control the scan driver, the data driver, the emission driver, and the power supply, wherein the timing controller is configured to generate the data signal based on an input image data.

3. The display device of claim 2, wherein the one or more power voltages includes a low power supply voltage, a high power supply voltage, a first initialization voltage, a second initialization voltage, and a bias voltage, wherein each of the plurality of scan line sets includes a first scan line, a second scan line, a third scan line, and a fourth scan line, and wherein each of the plurality of pixels includes:

a switching transistor that has a first electrode coupled to a data line of the plurality of data lines, a gate coupled to the first scan line, and a second electrode coupled to a first node;

a storage capacitor coupled between the high power supply voltage and a second node;

a driving transistor that has a first electrode coupled to the first node, a gate coupled to the second node, and a second electrode coupled to a third node;

a compensation transistor that has a first electrode coupled to the second node, a gate coupled to the third scan line, and a second electrode coupled to the third node;

a first initialization transistor that has a first electrode coupled to the second node, a gate coupled to the first scan line, and a second electrode coupled to the first initialization voltage;

a first emission transistor that has a first electrode coupled to the high power supply voltage, a gate receiving an emission control signal of the emission control signals, and a second electrode coupled to the first node;

a second emission transistor that has a first electrode coupled to the third node, a gate receiving the emission control signal of the emission control signals, and a second electrode coupled to a fourth node;

a second initialization transistor that has a first electrode coupled to the fourth node, a gate coupled to the fourth scan line, and a second electrode coupled to the second initialization voltage;

a bias transistor that has a first electrode coupled to the first node, a gate coupled to the fourth scan line, and a second electrode coupled to the bias voltage; and a light emitting element coupled between the fourth node and the low power supply voltage.

4. The display device of claim 3, wherein:

the second initialization transistor is configured to transfer the second initialization voltage to an anode of the light emitting element in response to the fourth scan signal received through the fourth scan line; and the bias transistor is configured to transfer the bias voltage to the first electrode of the driving transistor in response to the fourth scan signal received through the fourth scan line.

5. The display device of claim 2, wherein the one or more power voltages includes a low power supply voltage, a high power supply voltage, a first initialization voltage, a second initialization voltage, and a bias voltage, wherein each of the plurality of scan line sets includes a first scan line, a second scan line, a third scan line, and a fourth scan line, and wherein each of the plurality of pixels includes:

a switching transistor that has a first electrode coupled to a data line of the plurality of data lines, a gate coupled to the first scan line, and a second electrode coupled to a first node;

a storage capacitor coupled between the high power supply voltage and a second node;

a driving transistor that has a first electrode coupled to the first node, a gate coupled to the second node, and a second electrode coupled to a third node;

a compensation transistor that has a first electrode coupled to the second node, a gate coupled to the third scan line, and a second electrode coupled to the third node;

a first initialization transistor that has a first electrode coupled to the second node, a gate coupled to the first scan line, and a second electrode coupled to the first initialization voltage;

a first emission transistor that has a first electrode coupled to the high power supply voltage, a gate receiving an emission control signal of the emission control signals, and a second electrode coupled to the first node;

a second emission transistor that has a first electrode coupled to the third node, a gate receiving the emission control signal of the emission control signals, and a second electrode coupled to a fourth node;

a second initialization transistor that has a first electrode coupled to the fourth node, a gate coupled to the fourth scan line, and a second electrode coupled to the second initialization voltage;

a bias transistor that has a first electrode coupled to the third node, a gate coupled to the fourth scan line, and a second electrode coupled to the bias voltage; and a light emitting element coupled between the fourth node and the low power supply voltage.

6. The display device of claim 5, wherein the emission driver is configured to disable the emission control signal with a logic high level during the non-emission interval, wherein the non-emission interval includes consecutive horizontal periods including first through sixth horizontal periods, wherein the scan driver includes:

a first scan driver configured to generate the first scan signal, the second scan signal, and the third scan signal; and a second scan driver configured to generate the fourth scan signal, and wherein, for a k-th pixel row of the pixel rows, k being a natural number, the scan driver is configured to:

enable the fourth scan signal during the second horizontal period;

enable the first scan signal during the third horizontal period;

enable the second scan signal during the fourth and fifth horizontal periods; and enable the third scan signal during the fifth and sixth horizontal periods.

7. The display device of claim 6, wherein the scan driver is configured to use the third scan signal for the k-th pixel row as the second scan signal for a (k+1)-th pixel row of the pixel rows.

8. The display device of claim 5, wherein:

the second initialization transistor is configured to transfer the second initialization voltage to an anode of the light emitting element in response to the fourth scan signal received through the fourth scan line; and the bias transistor is configured to transfer the bias voltage to the second electrode of the driving transistor in response to the fourth scan signal received through the fourth scan line.

9. The display device of claim 5, wherein the emission driver is configured to disable the emission control signal with a logic high level during the non-emission interval, wherein the non-emission interval includes consecutive horizontal periods including first through sixth horizontal periods, wherein the scan driver includes:

a first scan driver configured to generate the first scan signal, the second scan signal and the third scan signal; and a second scan driver configured to generate the fourth scan signal, and wherein, for a k-th pixel row of the pixel rows, k being a natural number, the scan driver is configured to:

enable the first scan signal during the second and third horizontal periods;

enable the second scan signal during the third and fourth horizontal periods;

enable the third scan signal during the fourth and fifth horizontal periods; and enable the fourth scan signal during the sixth horizontal period.

10. The display device of claim 5, wherein a level of the first initialization voltage is greater than a level of the second initialization voltage.

11. The display device of claim 5, wherein the power supply is configured to vary a level of the second initialization voltage and a level of the bias voltage based on a frame rate of an image displayed in the display panel.

12. The display device of claim 5, wherein the emission driver is configured to disable the emission control signal with a logic high level during the non-emission interval, wherein the non-emission interval includes consecutive horizontal periods including first through sixth horizontal periods, wherein the scan driver includes:

a first scan driver configured to generate the first scan signal, the second scan signal, and the third scan signal; and a second scan driver configured to generate the fourth scan signal, and wherein, for a k-th pixel row of the pixel rows, k being a natural number, the scan driver is configured to:

enable the first scan signal during the second horizontal period;

enable the second scan signal during the third and fourth horizontal periods;

enable the third scan signal during the fourth and fifth horizontal periods; and enable the fourth scan signal during the sixth horizontal period.

13. The display device of claim 12, wherein the scan driver is configured to use the third scan signal for the k-th pixel row as the second scan signal for a (k+1)-th pixel row of the pixel rows.

14. The display device of claim 5, wherein the emission driver is configured to disable the emission control signal with a logic high level during the non-emission interval, wherein the non-emission interval includes consecutive horizontal periods including first through seventh horizontal periods, wherein the scan driver is configured to generate the first scan signal, the second scan signal, the third scan signal, and the fourth scan signal, wherein, for a k-th pixel row of the pixel rows, k being a natural number, the scan driver is configured to:

enable the first scan signal during the second horizontal period;

enable the second scan signal during the third and fourth horizontal periods;

enable the third scan signal during the fourth and fifth horizontal periods; and enable the fourth scan signal during the sixth and seventh horizontal periods.

15. The display device of claim 14, wherein the scan driver is configured to use the third scan signal for the k-th pixel row as the second scan signal for a (k+1)-th pixel row of the pixel rows.

16. The display device of claim 5, wherein the emission driver is configured to disable the emission control signal with a logic high level during the non-emission interval, wherein the non-emission interval includes consecutive horizontal periods including first through seventh horizontal periods, wherein the scan driver is configured to generate the first scan signal, the second scan signal, the third scan signal, and the fourth scan signal, wherein, for a k-th pixel row of the pixel rows, k being a natural number, the scan driver is configured to:

enable the fourth scan signal during the second and third horizontal periods;

enable the first scan signal during the fourth horizontal period;

enable the second scan signal during the fifth and sixth horizontal periods; and enable the third scan signal during the sixth and seventh horizontal periods.

17. The display device of claim 16, wherein the scan driver is configured to use the third scan signal for the k-th pixel row as the second scan signal for a (k+1)-th pixel row of the pixel rows.

18. A method of driving a display device comprising:

outputting data voltages to a plurality of pixels of a display panel, by a data driver connected to the display panel through a plurality of data lines; and sequentially outputting a plurality of scan signals to each of a plurality of pixel rows of the plurality of pixels, by a scan driver connected to the display panel through a plurality of scan line sets, wherein the scan driver is configured to enable at least two scan signals of the plurality of scan signals including a first scan signal, a second scan signal, a third scan signal, and a fourth scan signal, which are applied to each of the pixel rows during a non-emission interval, partially overlapping the at least two scan signals during at least two consecutive horizontal periods, wherein a horizontal period corresponds to a period in which the driving circuit provides the data voltages to a pixel row of the plurality of pixels, and wherein each of the plurality of scan line sets includes a first scan line, a second scan line, a third scan line, and a fourth scan line.

19. The method of claim 18, wherein each of the plurality of pixels includes:

a switching transistor that has a first electrode coupled to a data line of the plurality of data lines, a gate coupled to the first scan line, and a second electrode coupled to a first node;

a storage capacitor coupled between a high power supply voltage and a second node;

a driving transistor that has a first electrode coupled to the first node, a gate coupled to the second node, and a second electrode coupled to a third node;

a compensation transistor that has a first electrode coupled to the second node, a gate coupled to the third scan line, and a second electrode coupled to the third node;

a first initialization transistor that has a first electrode coupled to the second node, a gate coupled to the first scan line, and a second electrode coupled to a first initialization voltage;

a first emission transistor that has a first electrode coupled to the high power supply voltage, a gate receiving an emission control signal, and a second electrode coupled to the first node;

a second emission transistor that has a first electrode coupled to the third node, a gate receiving the emission control signal, and a second electrode coupled to a fourth node;

a second initialization transistor that has a first electrode coupled to the fourth node, a gate coupled to the fourth scan line, and a second electrode coupled to a second initialization voltage;

a bias transistor that has a first electrode coupled to the third node, a gate coupled to the fourth scan line, and a second electrode coupled to a bias voltage; and a light emitting element coupled between the fourth node and a low power supply voltage.

20. The method of claim 19, wherein the emission control signal is disabled with a logic high level during the non-emission interval, wherein the non-emission interval includes consecutive horizontal periods including first through sixth horizontal periods, wherein the scan driver includes:

a first scan driver configured to generate a first scan signal, a second scan signal, and a third scan signal; and a second scan driver configured to generate a fourth scan signal, and wherein, for a k-th pixel row of the pixel rows, k being a natural number, the scan driver is configured to:

enable the fourth scan signal during the second horizontal period;

enable the first scan signal during the third horizontal period;

enable the second scan signal during the fourth and fifth horizontal periods; and enable the third scan signal during the fifth and sixth horizontal periods.

* * * * *